US005253020A

United States Patent [19]

Matsushita et al.

[11] Patent Number: 5,253,020

[45] Date of Patent: Oct. 12, 1993

[54] IMAGE FORMING APPARATUS IMPROVED IN TONER SUPPLY OPERATION

[75] Inventors: Tetsuo Matsushita, Shinshiro; Shoji Kashiwagi, Okazaki; Tsuneo Kitagawa, Toyohashi, all of Japan

[73] Assignee: Minolta Camera Kakbushiki Kaisha, Osaka, Japan

[21] Appl. No.: 870,790

[22] Filed: Apr. 16, 1992

Related U.S. Application Data

[63] Continuation of Ser. No. 592,677, Oct. 4, 1990, abandoned.

[30] Foreign Application Priority Data

Oct. 5, 1989 [JP] Japan ..... 1-260779

[51] Int. Cl.[5] ..... G03G 15/06

[52] U.S. Cl. ..... 355/260; 355/206; 355/208; 355/246

[58] Field of Search ..... 355/203, 204, 206, 208, 355/246, 260

[56] References Cited

U.S. PATENT DOCUMENTS

| | | | |
|---|---|---|---|
| 4,462,680 | 7/1984 | Ikeda | 355/246 |
| 4,648,702 | 3/1987 | Goto | 355/208 |
| 4,734,737 | 3/1988 | Koichi | 355/206 |
| 4,803,521 | 2/1989 | Honda | 355/208 |
| 4,901,115 | 2/1990 | Nakamura et al. | 355/246 |
| 4,951,091 | 8/1990 | Nawata | 355/206 |
| 4,956,669 | 9/1990 | Nakamura | 355/208 |
| 5,043,764 | 8/1991 | Arnold et al. | 355/208 |

FOREIGN PATENT DOCUMENTS

| | | |
|---|---|---|
| 58-195854 | 11/1983 | Japan . |
| 60-76775 | 5/1985 | Japan . |

*Primary Examiner*—Michael L. Gellner
*Assistant Examiner*—P. Stanzione
*Attorney, Agent, or Firm*—Willian Brinks Olds Hofer Gilson & Lione

[57] ABSTRACT

An image forming apparatus according to the present invention is provided with a developing unit which develops an electrostatic latent image formed on an electrostatic latent image holding body. The image forming apparatus comprises a measuring device for measuring toner concentration in the developing unit, a toner container for storing toner, a first supply unit for supplying a predetermined amount of toner from the toner container to the developing unit when it is determined that the toner concentration measured by the measuring device is lower than a first predetermined concentration, a second supply unit for supplying from the toner container to the developing unit toner of a larger amount than the first supply unit, a storage device for storing predetermined information related to concentration when it is determined that the toner concentration measured by said measuring device is below a second predetermined concentration lower than the first predetermined one, and an actuating device for actuating the second supply unit if the predetermined information has been stored in said storage device when power is turned on.

12 Claims, 22 Drawing Sheets

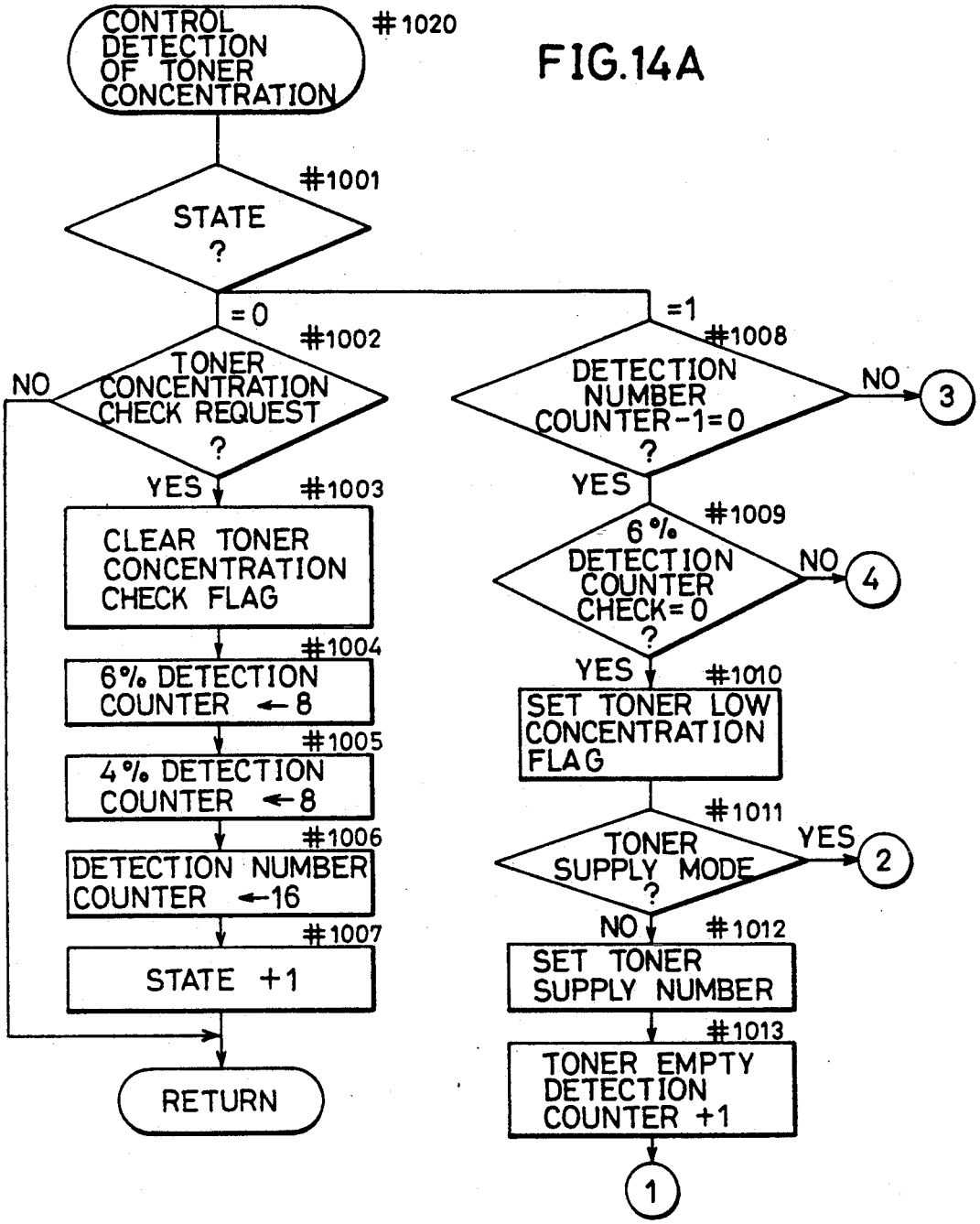
CONTROL DETECTION OF TONER CONCENTRATION
#1020
FIG.14A
#1001
STATE ?
=0
=1
#1002
TONER CONCENTRATION CHECK REQUEST ?
NO
YES
#1003
CLEAR TONER CONCENTRATION CHECK FLAG
#1004
6% DETECTION COUNTER ←8
#1005
4% DETECTION COUNTER ←8
#1006
DETECTION NUMBER COUNTER ←16
#1007
STATE +1
RETURN
#1008
DETECTION NUMBER COUNTER-1=0 ?
NO
3
YES
#1009
6% DETECTION COUNTER CHECK=0 ?
NO
4
YES
#1010
SET TONER LOW CONCENTRATION FLAG
#1011
TONER SUPPLY MODE ?
YES
2
NO
#1012
SET TONER SUPPLY NUMBER
#1013
TONER EMPTY DETECTION COUNTER +1
1

IMAGE FORMING APPARATUS IMPROVED IN TONER SUPPLY OPERATION

This application is a continuation of application Ser. No. 07/592,677, filed Oct. 4, 1990, now abandoned.

BACKGROUND OF THE INVENTION

1. Field of the Invention

The present invention generally relates to image forming apparatuses such as laser printer and copying machine, and more particular, to an image forming apparatus improved in its toner supply operation.

2. Description of the Related Art

For copying machines, two types of developer are available; one is of unary system and the other is of binary system. The developer of binary system is composed of toner and carrier which have different polarities. The toner serving as colorant is absorbed by a photoreceptor, thus allowing an electrostatic latent image on the photoreceptor to emerge clearly. In the developer of binary system, therefore, carrier is not consumed at all but toner is always exhausted.

In a conventional copying machine, toner is fed from a toner container and supplied to a developing unit through supply means. Then, detection is made on presence or absence of toner in the toner container. When toner is used up, a "toner empty lamp" is lighted and an operator is informed that the toner container is emptied so as to require the operator to exchange the emptied toner container.

However, conventional copying machines can continue copying operation even when the toner empty lamp is lighted. When copying operation is continued with the toner empty lamp lighted, the toner concentration in the developing unit is gradually reduced, resulting in a reduced image density of copies. This problem is attributable to the fact that presence or absence of toner in the toner container is detected only indirectly by using a toner concentration sensor in a developer tank, and not detected directly in the toner container. That is, there occurs a time delay between the time toner in the toner container is actually used up and the time the toner concentration begins to decrease. Therefore, especially when the detection of emptiness of the toner container is delayed and copying operation is continued after the toner empty lamp is lighted, the problem becomes significant. Furthermore, if the toner container is exchanged after the image density has been considerably reduced and copying operation is resumed with toner being supplied as usual, it takes some time for the toner concentration to reach a predetermined value. As a result, the initial several copies taken during that period show a low image density and poor image quality.

SUMMARY OF THE INVENTION

An object of the present invention is to enhance reliability of an image forming apparatus.

Another object of the present invention is to maintain an appropriate image density in an image forming apparatus.

Still another object of the present invention is to enhance reliability of image density after power is turned on in an image forming apparatus.

To achieve the objects described above, an image forming apparatus according to one aspect of the present invention provided with a developing unit for developing an electrostatic latent image formed on an electrostatic latent image holding body comprises measuring means for measuring the toner concentration in the developing unit, a toner container for storing toner, first supply means for supplying toner of a predetermined amount from the toner container to the developing unit when it is determined that the toner concentration measured by measuring means is lower than a predetermined first concentration, second supply means for supplying from the toner container to the developing unit toner of a larger amount than the first supply means, storage means for storing predetermined information related to concentration when it is determined that the toner concentration measured by the measuring means is below a second predetermined concentration lower than the first one, and actuating means for actuating the second supply means if the predetermined information has been stored in the storage means when power is turned on.

In an image forming apparatus configured as described above, an appropriate image density is always maintained since based on the predetermined information, toner is supplied rapidly after power is turned on.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 14A and 14B are flow chart diagrams showing specific contents of routines for controlling detection of toner concentration.

DESCRIPTION OF THE PREFERRED EMBODIMENTS

In the following, the present invention will be described in detail with reference to the accompanying drawings showing an embodiment thereof.

Figure 1:
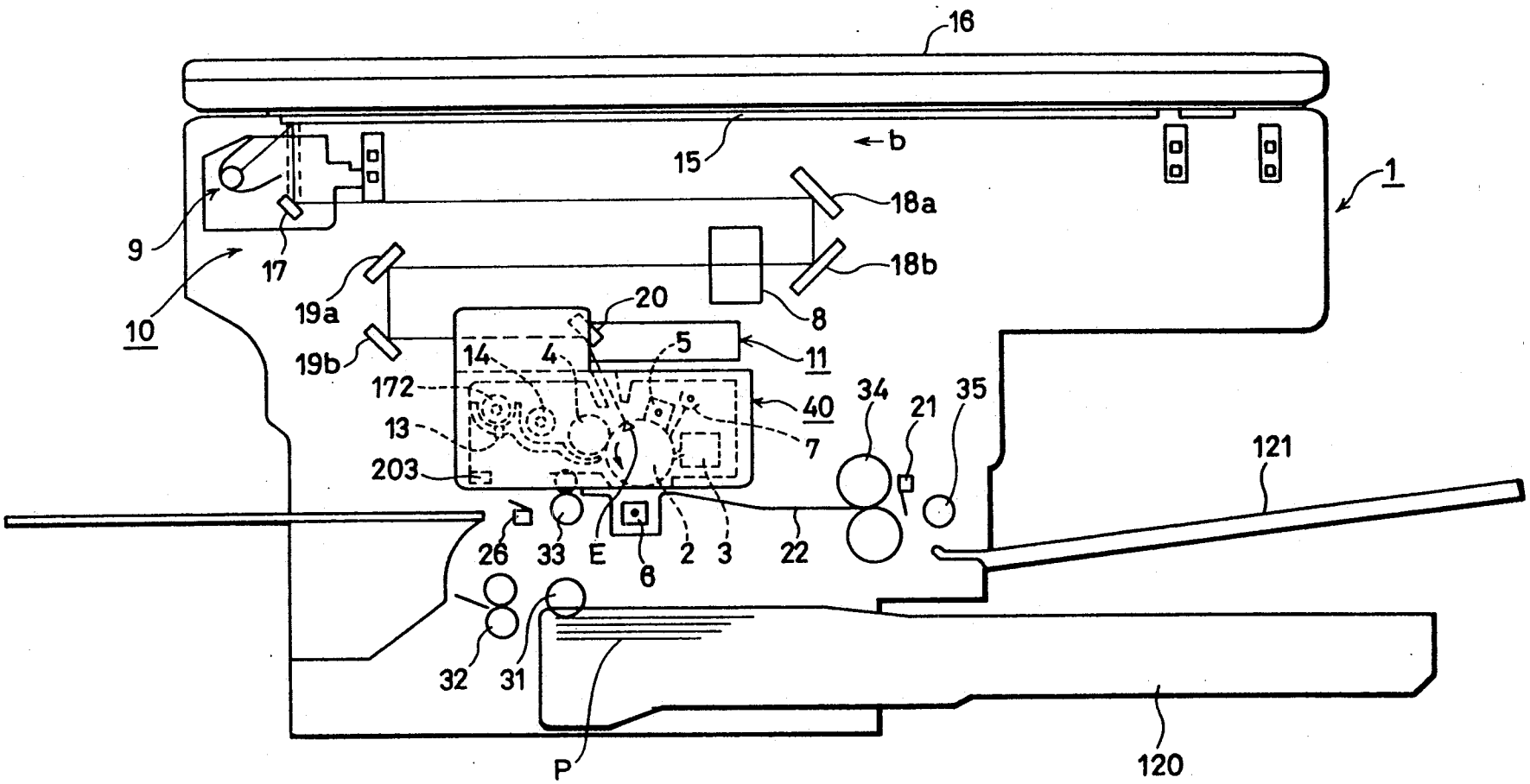
FIG. 1 is a schematic sectional view showing internal structure of a copying machine, or image forming apparatus according to an embodiment of the present invention.
Figure 2:
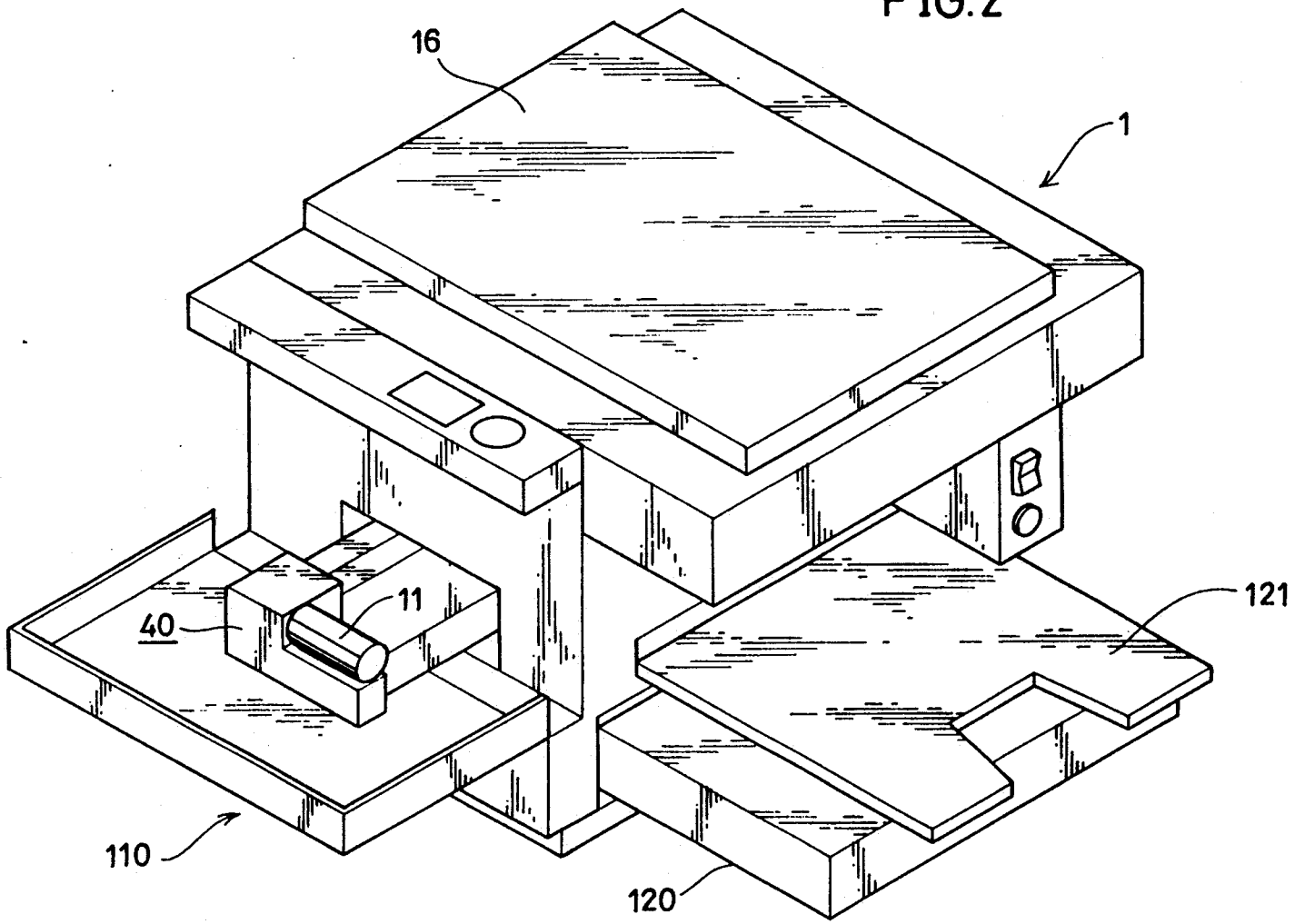
FIG. 2 is a schematic perspective view of the copying machine shown in FIG. 1, with an image forming unit being drawn therefrom.

FIG. 1 is a schematic sectional view showing internal structure of a copying machine, or image forming apparatus according to an embodiment of the present invention. FIG. 2 is a perspective view of the copying machine with its image forming unit being drawn therefrom. In the diagrams, machine body 1 has glass platen 15 provided on its upper surface. An original placed on platen 15 is scanned by optical scanning device 10 driven by an unshown scan motor, and is imaged on photoreceptor drum 2 as an electrostatic latent image.

Optical scanning device 10 is constituted of an optical system comprising exposure lamp 9, movable mirrors 17, 18*a* and 18*b*, lens 8, fixed mirrors 19*a* and 19*b* and so on. Light from the original, which has been reflected from or transmitted through these elements in the order named, irradiates photoreceptor drum 2 at a predetermined exposure position E. Meanwhile, a first slider provided with exposure lamp 9 and movable mirror 17 and a second slider provided with movable mirrors 18*a* and 18*b* are driven by the scan motor to move in the direction of arrow b. At this time, the first slider moves at a speed twice that of the second slider to scan the original. In FIG. 1, there are shown positions of the first and second sliders scanning in their maximum ranges.

On platen 15, there is provided cover 16 which is hinged along the edge on its backside and can be lifted up with the edge on its front side to expose platen 15. To copy an original, cover 16 is opened, a sheet of paper or bound sheets of a book is put on platen 15 with its original image directed downward, and then cover 16 is closed on the platen.

Further, on the front side of body 1, there is provided front cover 110 as shown in FIG. 2 which is rotatably pivoted on its underside. When the upper potion of front cover 110 is detached from/attached to body 1, body 1 is opened/closed, allowing image forming unit 40 described later to be drawn/inserted. In addition, upon opening/closing of cover 110, power is turned on/off in body 1.

Photoreceptor drum 2 has a photoconductive layer on its peripheral surface, and can be driven to rotate counterclockwise as indicated by an arrow. Above photoreceptor drum 2, there is disposed sensitizing charger 5 to apply a certain potential to a surface of photoreceptor drum 2.

The circumferential speed V of photoreceptor drum 2 is constant and the travel speeds of the first and second sliders in optical scanning device 10 are V and V/2, respectively.

In the downstream from exposure position E in the rotating direction of photoreceptor drum 2, there is provided a developing unit. The developing unit is constituted of developing roller 4, first and second screws 14 and 172. The toner supplied from developer supply unit 11 is circulated between the second and first screws so as to be mixed and stirred up. The thus mixed developer is supplied from the second screw to the developing roller 4. Developing roller 4 makes an electrostatic latent image, which has been formed on a surface of photoreceptor drum 2, emerge clearly as a toner image by magnetic brush method. Under photoreceptor drum 2, there is provided transfer charger 6. This transfer charger 6 applies an electric field to the backside of a sheet of copy paper P transported from cassette 120 as will be described later, and transfers onto the sheet of copy paper P the toner image which has been formed by developing roller 4 on the surface of photoreceptor drum 2.

In the downstream from transfer charger 6 in the rotating direction of photoreceptor drum 2, there is provided cleaning device 3. Cleaning device 3 removes the toner remaining on a surface of photoreceptor drum 2 by a blade. Between cleaning device 3 and sensitizing charger 5, there is provided eraser lamp 7. Eraser lamp 7 removes charges remaining, due to the irradiated light, on a surface of photoreceptor drum 2 for the subsequent copying operation.

Further, photoreceptor drum 2, eraser lamp 7, first screw 14, second screw 172, developing roller 4, cleaning device 3 and sensitizing charger 5 are incorporated in image forming unit 40. Image forming unit 40 can be detached from body 1.

Over image forming unit 40, there is provided developer supply unit 11. Developer supply unit 11 supplies a certain amount of developer to the second screw 172. Further, in image forming unit 40, there is provided $E^2$PROM (Electrically Erasable & Programmable ROM) 203 to store information such as emptiness of toner and number of image formations. Toner concentration sensor 13 for detecting toner concentration is provided under the second screw 172. The toner concentration represents composition ratio between toner and carrier. A magnetic sensor used as toner concentration sensor 13 detects amount of carrier including magnetic substance and thus detects the composition ratio between toner and carrier.

Figure 3:
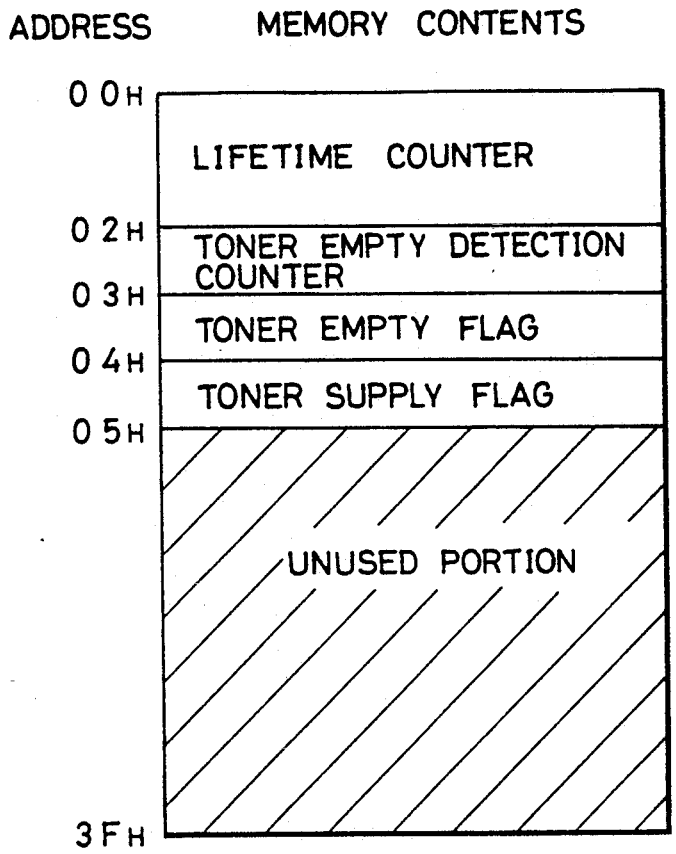
FIG. 3 is a diagram showing memory contents of $E^2$PROM in the image forming unit shown in FIG. 2.

FIG. 3 is a diagram showing memory contents of $E^2$PROM. $E^2$PROM 203 has address space of $2^6(=3F_H)$. Address space 00 to $01_H$ is used to hold count values of an image formation counter which is incremented for every copying operation so as to detect lifetime of image forming unit 40. Address space $02_H$ is used to hold count values of a toner empty counter which counts when a toner concentration at a copying operation is below a certain value so as to detect that toner has been emptied. Address space $03_H$ is used as an area for a toner empty flag. Address space $04_H$ is used as an area for a toner supply flag indicating that additional toner must be supplied unconditionally after an exchange of toner containers 141 described later when a toner concentration is no more than 4% with the toner empty flag set. When the apparatuses are forwarded to users, some predetermined data has been stored in specific areas, based on which it is determined whether image forming unit 40 has been already used or not at all.

As described above, according to the present embodiment, the image formation counter, the toner empty flag, the toner empty counter and the toner supply flag are stored in a non-volatile memory, $E^2$PROM 203 provided in image forming unit 40. Therefore, even when image forming unit 40 which has been once drawn out of body 1 is inserted into body 1 again, information of lifetime, emptied toner and toner supply are held without being reset.

Figure 4:
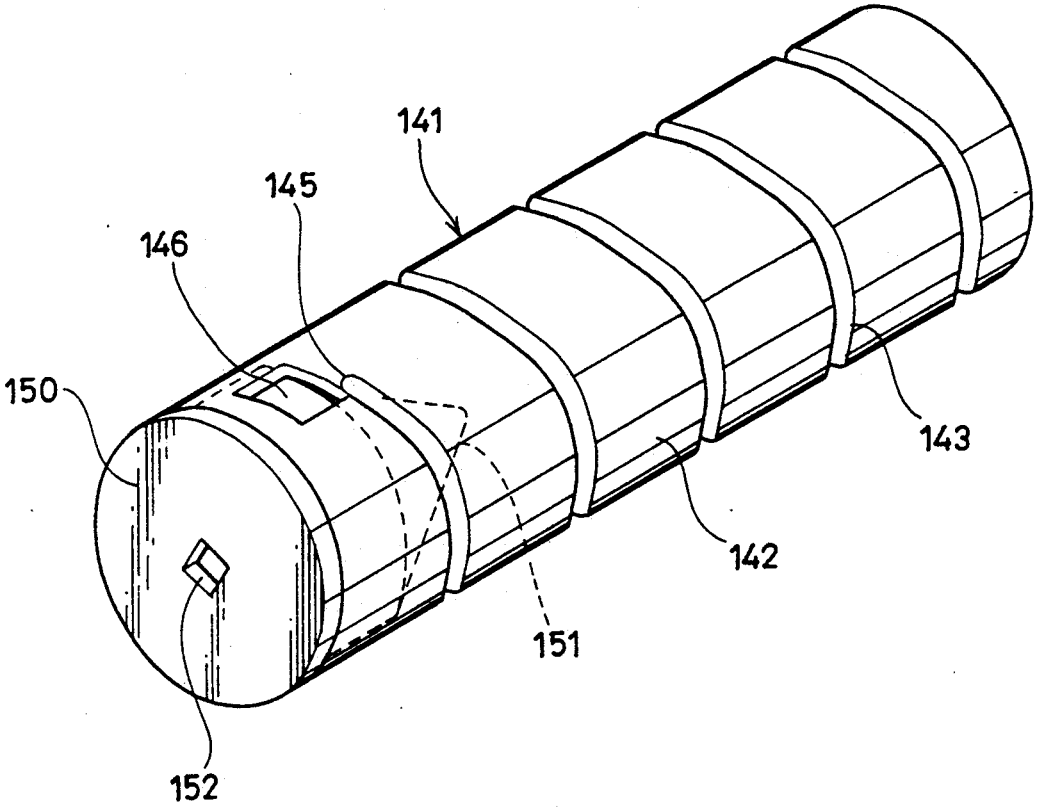
FIG. 4 is a perspective view showing structure of the developer supply unit shown in FIG. 1.
Figure 5:
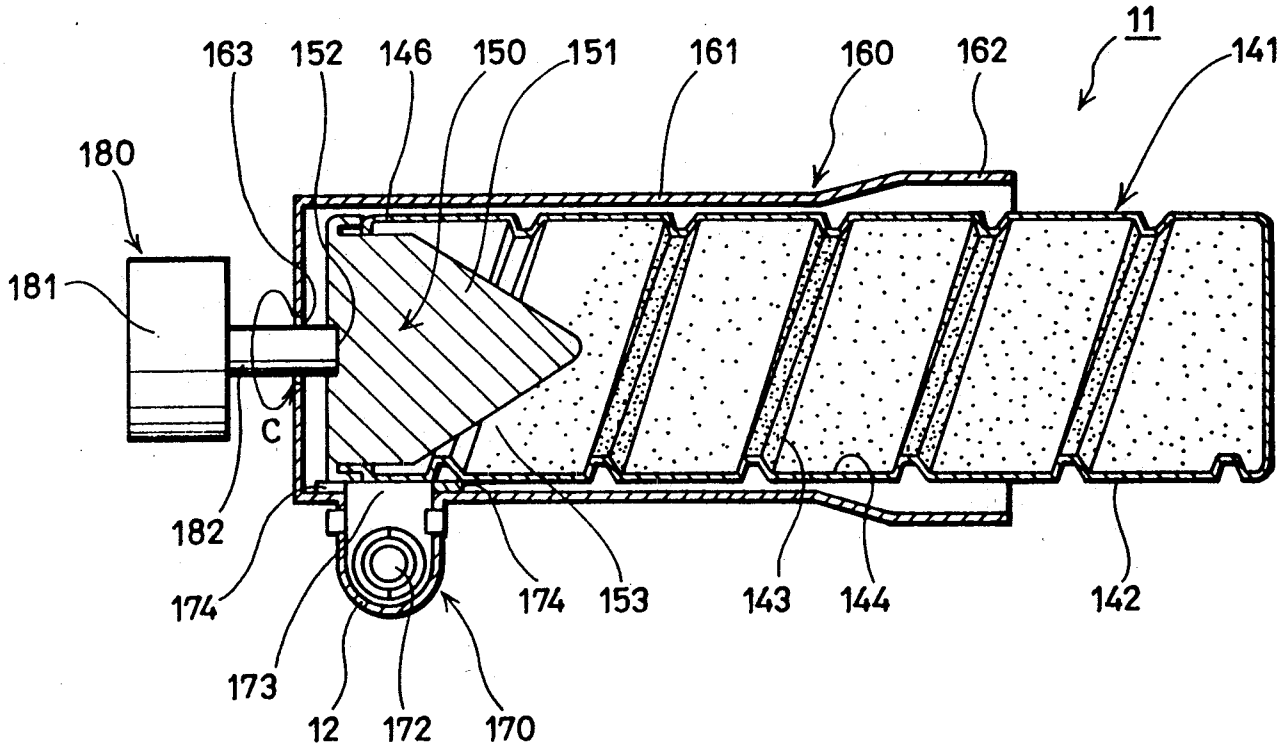
FIG. 5 is a sectional view showing structure of the developer supply unit shown in FIG. 4.

FIG. 4 is a perspective view showing structure of a developer supply unit (referred to as "toner container" hereinafter). FIG. 5 is a longitudinal sectional view showing structure of the toner container. In the diagrams, toner container 141 is comprised of cylinder 142 one end of which is opened and the other is closed, and cap 150 detachably provided on the open end of cylinder 142. Meanwhile, the other end of cylinder 142 may be covered with a cap.

Cylinder 142 is integrally formed of thermoplastic resin by blow molding and has ridge 143 formed helically along the inner surface of cylinder 142 to project inwardly. Between ridges 143, there is formed helical groove 144. Toward the open end of cylinder 142, there is provided opening 146 in the vicinity of terminal portion 145 of helical groove 144.

Cap 150 has conical restricting portion 151 which has its apex on the central axis of cylinder 142 and extends toward the closed end of cylinder 142. Cap 150 has concave 152 at the center of its outer surface. Meanwhile, restricting portion 151 may be semi-spherical or semi-elliptic.

Toner container 141 configured as described above has its opening 146 of cylinder 142 covered with an unshown seal tape and the like and is loaded with toner before sealed by cap 150. Meanwhile, starter, another type of developer composed of toner and magnetic carrier may be loaded instead of toner.

In FIG. 5, there are shown hold portion 160, transport portion 170 and drive portion 180 of toner container 141.

Hold portion 160 has cylinder 161 whose one end is opened. This cylinder 161 has an inside diameter little larger than the outside diameter of the above-mentioned cylinder 142. The open end of cylinder 161 has an increased inside diameter to serve as guide portion 162. Further, cylinder 161 has a hole 163 formed at the center of its closed end. Hold portion 160 is supported horizontally together with transport portion 170.

Transport portion 170 is constituted of transport conveyer 12 which accommodates one end of the second screw 172 therein and is coupled with developing unit 4 as previously described. The second screw 172 is driven by an unshown motor and the like to rotate. Furthermore, at a connecting portion between transport portion 170 and hold portion 160, there is formed opening 173. Seal members 174 and 174 are provided to inner surfaces of cylinder 161 surrounding opening 173 on its right and left sides in the diagram.

Drive portion 180 comprises motor 181, whose drive shaft 182 is inserted into hole 163 of cylinder 161.

In developer supply unit 11 configured as described above, toner container 141 has the seal tape over opening 146 stripped off, and inserted into cylinder 161 from the end having cap 150 with opening 146 on its upper side, as shown in FIG. 5. Then, drive shaft 182 engages with concave 152 to support, together with cylinder 161, the thus inserted toner container 141.

Toner container 141 supported by hold portion 160 rotates in the direction of arrow c with the rotation of drive shaft 182 driven by motor 181.

Thus, toner in toner container 141 travels toward the side of cap 150 along helical groove 144. When it reaches a space 153 between restricting portion 151 of cap 150 and the inner surface of toner container 141 (referred to as "restricting space" hereinafter), whose sectional area is reduced as getting close to the open end, the travel of toner or developer toward the open end is restricted so that only a certain amount of toner reaches the open end.

The toner having reached the open end along helical groove 144 drops onto transport conveyer 12 through openings 146 and 173 when opening 146 is positioned downward with the rotation of toner container 141. That is, a certain amount of toner is supplied to transport conveyer 12 each time toner container 141 rotates. Then, the toner supplied to transport conveyer 12 is transported to developing unit 4 due to rotation of the second screw 172.

Meanwhile, cassette 120 shown in FIG. 1, which receives sheets of copy paper P, can be detached from body 1 and has paper supply roller 31 provided thereon. Paper supply roller 31 is driven by an unshown motor to rotate which is provided in and coupled with the roller. Copy paper P fed from cassette 120 is supplied through intermediate roller 32 to timing roller 33 to be further fed in between photoreceptor drum 2 and transfer charger 6 at certain timings.

A sheet of copy paper P having a toner image transferred thereon is fed to fixing device 34 through transport pass 22. Fixing device 34 fixes the toner image on the sheet of copy paper P by heat. The sheet of copy paper P having the image fixed thereon is discharged to discharge tray 121.

Figure 6:
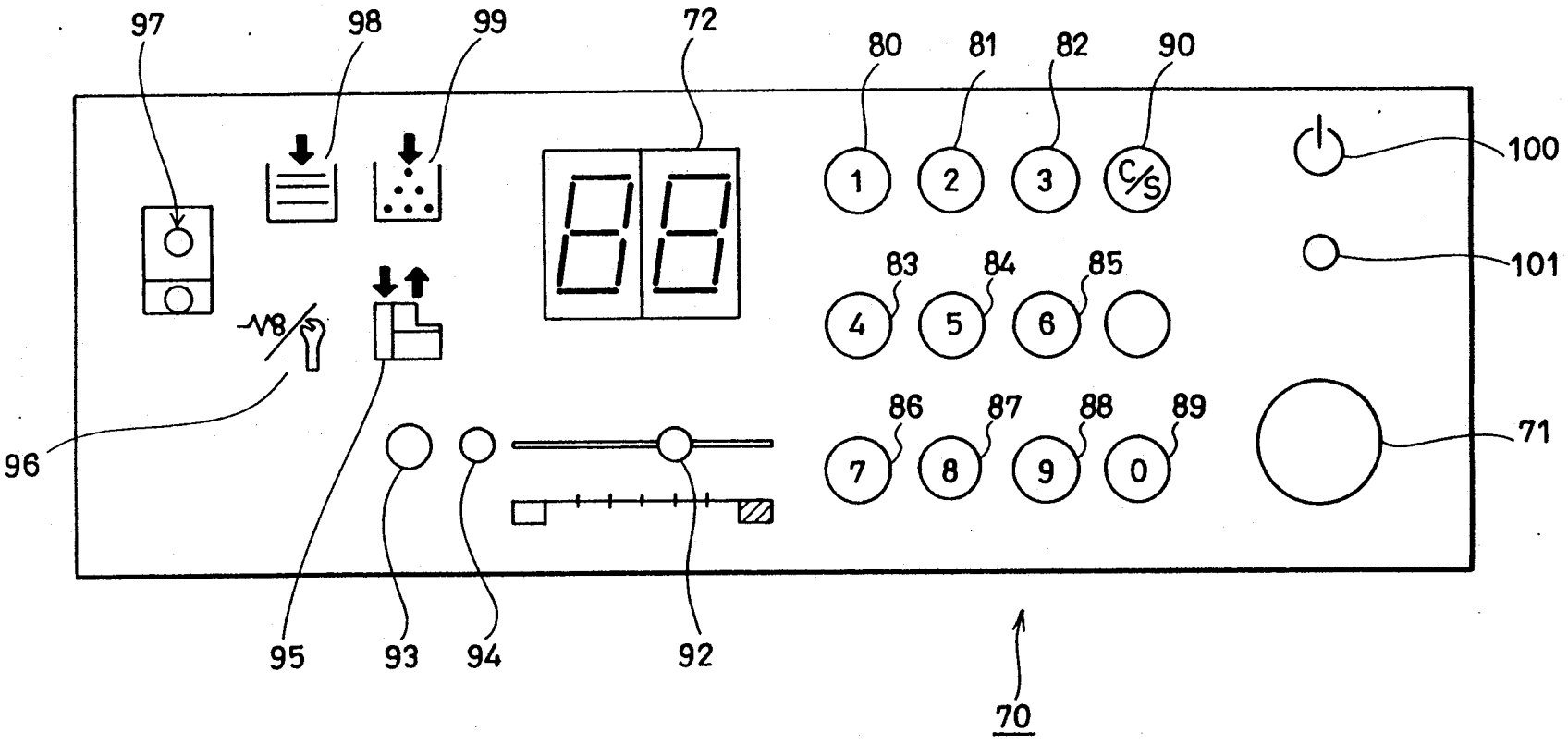
FIG. 6 is a plan view showing an operation panel provided to the image forming apparatus shown in FIG. 1.

FIG. 6 is a plan view showing an operation panel provided on a front portion of platen 15. On operation panel 70, there are disposed print key 71 for starting for copying operation at its right corner and display 72 for indicating number of copies at its center, which is comprised of two LEDs having 7 segments.

Ten-key 80 to 89 arranged on the right side of print key 71 is used mainly for inputting number of copies. Clear stop key (C/S key) 90 is used to cancel registered numbers and suspend copying operation. Further, the concentration of a copied image can be continuously set by exposure volume 92 arranged below display 72. On the left side of exposure volume 92, there are disposed automatic/manual exposure key 93 for selecting either automatic or manual exposure, and LED 94, which is lighted when the automatic exposure has been selected.

On the upper side of automatic/manual exposure key 94, there is disposed LED 95 for indicating, based on lifetime (=number of image formations) of image forming unit 40, that an exchange of image forming units is required. Further, on the left side of LED 95, there is disposed display LED 96 for indicating that jamming or other failure is taking place. On the upper side of display LED 96, there are disposed paper empty LED 98 for indicating that there remains no copy paper P in cassette 120, and toner empty LED 99 for indicating that toner container 141 has been emptied. On the left side of those LEDs described above, there is provided jamming display 97 for indicating a jamming portion, which is represented as either body 1 or cassette 120. Furthermore, on the upper side of print key 71, there are disposed copy inhibit LED 100 for indicating that copying is inhibited while jamming and the like is taking place, and copy wait display LED 101 for indicating that copying is waited during warming-up, a fast toner supply mode and the like.

Figure 7:
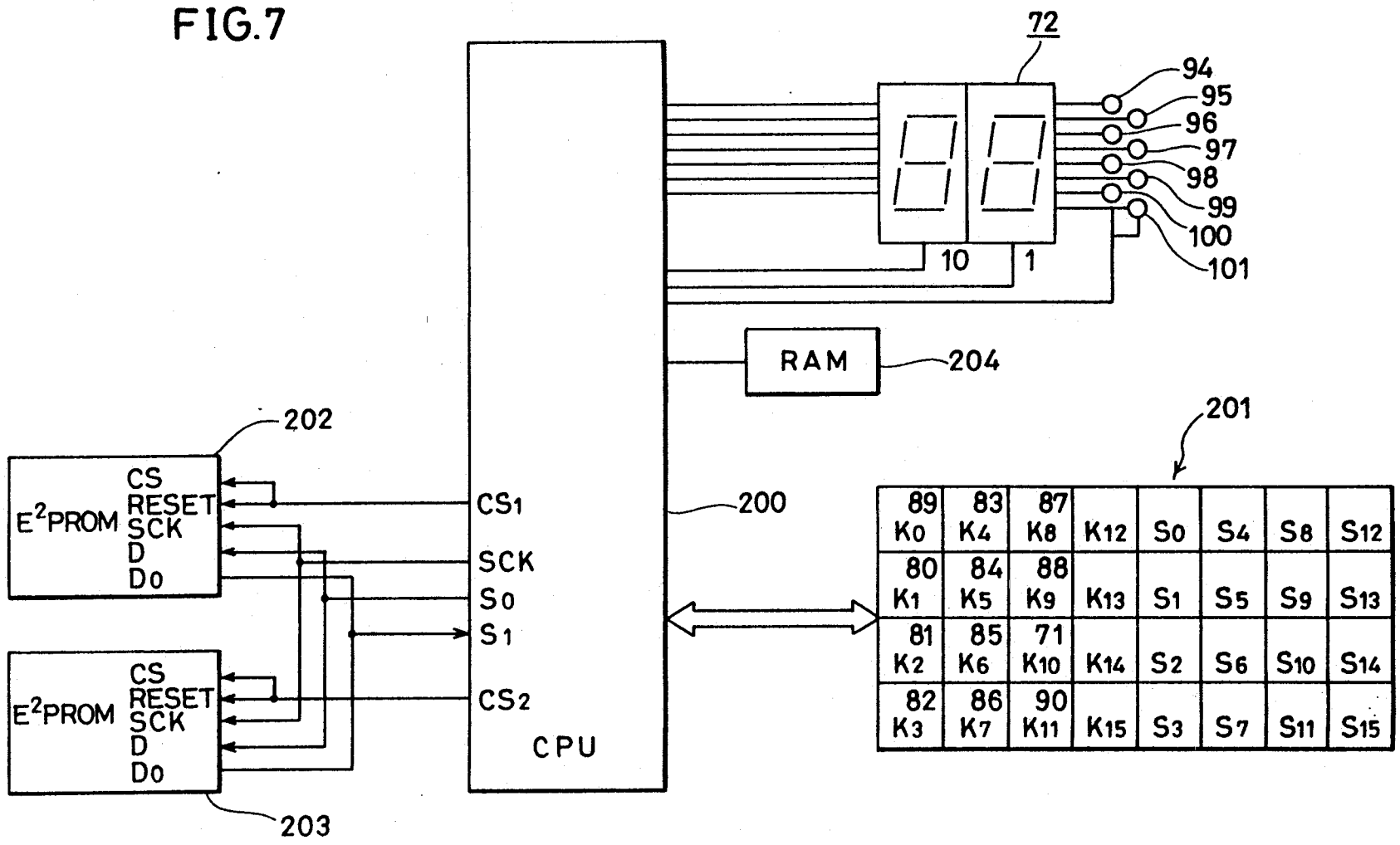
FIG. 7 is a block diagram showing structure of a control circuit in the image forming apparatus shown in FIG. 1.

FIG. 7 is a block diagram showing structure of a control circuit in a copying machine according to an embodiment of the present invention, which comprises microcomputer (referred to as "CPU" hereinafter) 200 for controlling the copying machine. CPU 200 is connected to switch matrix 201 constituted of a group of keys on operation panel 70 and switch portions of various sensors, display portion 72 for indicating number of copies and various display LEDs 94 to 101. Further, CPU 200 has an output port for controlling copying and scanning operations, which is connected to drive circuits (not shown) of the respective elements such as main motor 27, unshown developing motor and timing roller clutch, sensitizing charger 5 and transfer charger 6. Furthermore, chip select terminals CS1 and CS2, serial clock terminal SCK, data input/output terminals SI and SO are provided to the machine body and connected to corresponding terminals of E²PROM 202 which stores information of modes, number of copies and the like, and of E²PROM 203 provided in image forming unit 40 to store information indicating state of image forming unit 40. Furthermore, CPU200 is connected to RAM 204 which temporarily stores control programs of body 1 and flags indicative of states of body 1.

Now, referring to flow charts shown in FIGS. 8 to 16, control procedure of CPU 200 will be described. Meanwhile, before those flow charts are described, the terms "on edge" and "off edge" used therein will be defined below.

"On edge" is defined as representing a changing state which appears when switches, sensors, signals and the like change from the off-state to the on-state.

"Off-edge" is defined as representing a changing state which appears when switches, sensors, signals and the like change from the on-state to the off-state.

Figure 8:
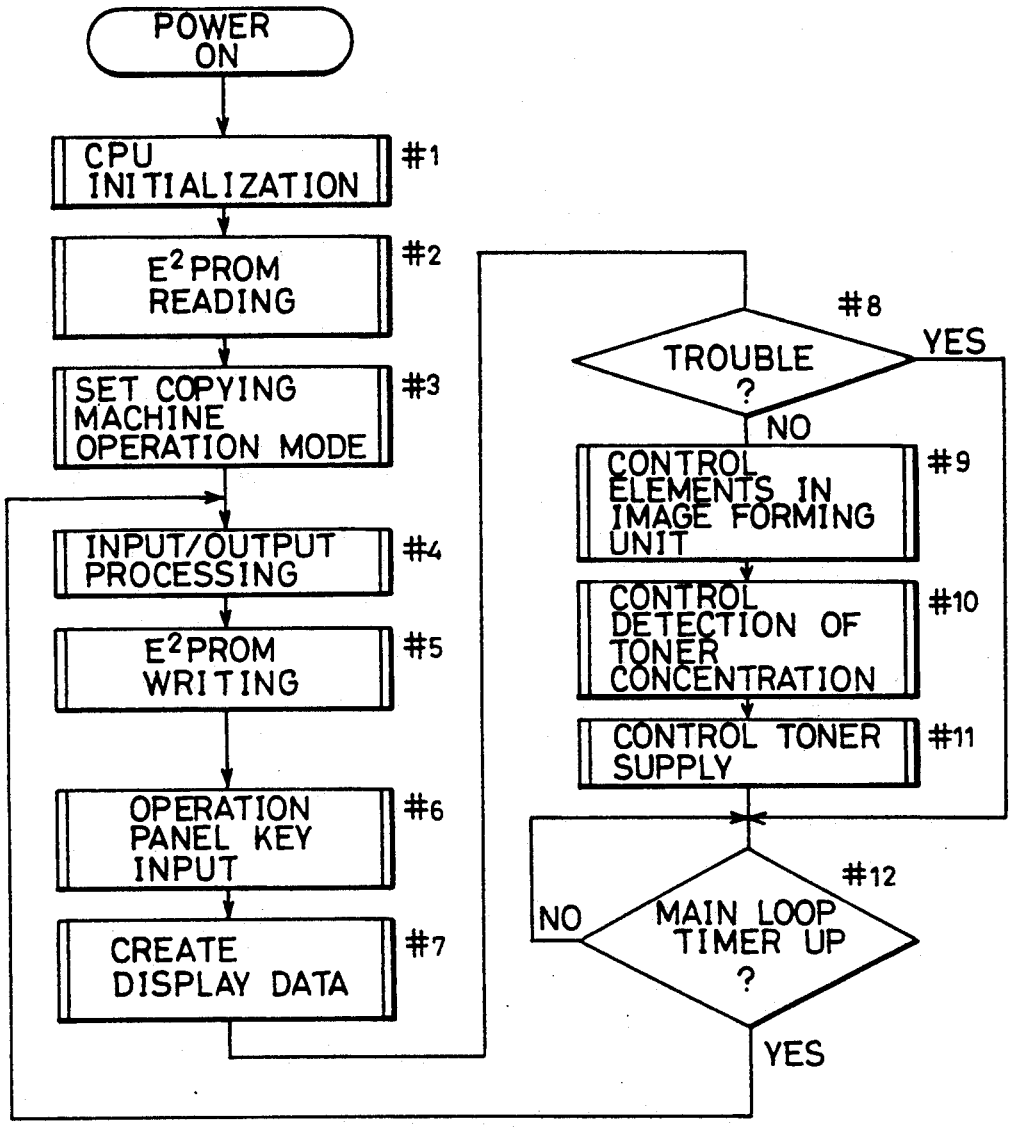
FIG. 8 is a flow chart diagram showing the main routine executed by CPU in the control circuit shown in FIG. 7.

FIG. 8 is a flow chart diagram showing the main flow of CPU 200, along which the entire operation will be described briefly.

First, when power is turned on, CPU 200 is initialized (step #1). Subsequently, data is read out of E²PROMs 202 and 203 (step #2). More specifically, connections to E²PROMs 202 and 203 are checked and data stored in E²PROMs 202 and 203 is read out. When the reading from E²PROMs is completed, operation mode of the copying machine is set based on the data read out of E²PROMs 202 and 203 (step #3). For example, when image forming unit 40 has not been used yet, specific data stored in a predetermined area of E²PROM 202 is detected to set a developer (starter) set mode.

Subsequently, determinations are made as to whether various input/output switches have been turned on or not (step #4) which are used for input processing where states of various keys and switches on operation panel 70 connected to outside of CPU 200, and several sensors are read, A/D input processing where levels at analogue input terminals of CPU 200 are read, output processing where levels of output terminals of CPU 200 are set, and the like. Thereafter, subroutines to read from and writing to E²PROMs 202 and 203 are executed (step #5). The reading/writing processing to and from E²PROMs 202 and 203 are done when required in each control program. After this processing is completed, operation panel key input processing is performed at step #6 to identify inputs through the keys on operation panel 70 and make processings corresponding to the respective keys. More specifically, at step #6, doubly depressed states of the operation switches on the operation panel are identified and further it is determined which key input is accepted as effective. Thereafter, processings corresponding to the effective key inputs are made.

At step #7, display data for setting contents of display 72 on operation panel 70 is created. When all the data is created, it is examined whether a trouble such as jamming in machine body 1 and abnormal temperatures at fixing device 34 has occurred or not (step #8). When some trouble has occurred, the following control is not performed but the apparatus waits until a time set for the main routine has passed. When no trouble has occurred, control is made on respective elements such as photoreceptor drum 2 and developing unit 4 in image forming unit 40 (step #9). Meanwhile, in this subroutine, when a determination is made that the toner supply flag has been set in the subroutine of reading from E²PROM (step #2), toner supply is controlled at the time of a container exchange. Thereafter, concentration of toner is detected and the detection of toner concentration is controlled to control the concentration at predetermined timings in a copying cycle (step #10). Subsequently, the normal subroutine for controlling toner supply is executed, where toner is supplied when the toner concentration becomes low (step #11).

At step #12, determination is made as to whether a predetermined time corresponding to one loop of the main routine has passed or not. The operation waits until the time has passed and then returns to step #4.

In the following, only those parts of the respective subroutines that are related to the present invention will be described.

Figure 9:
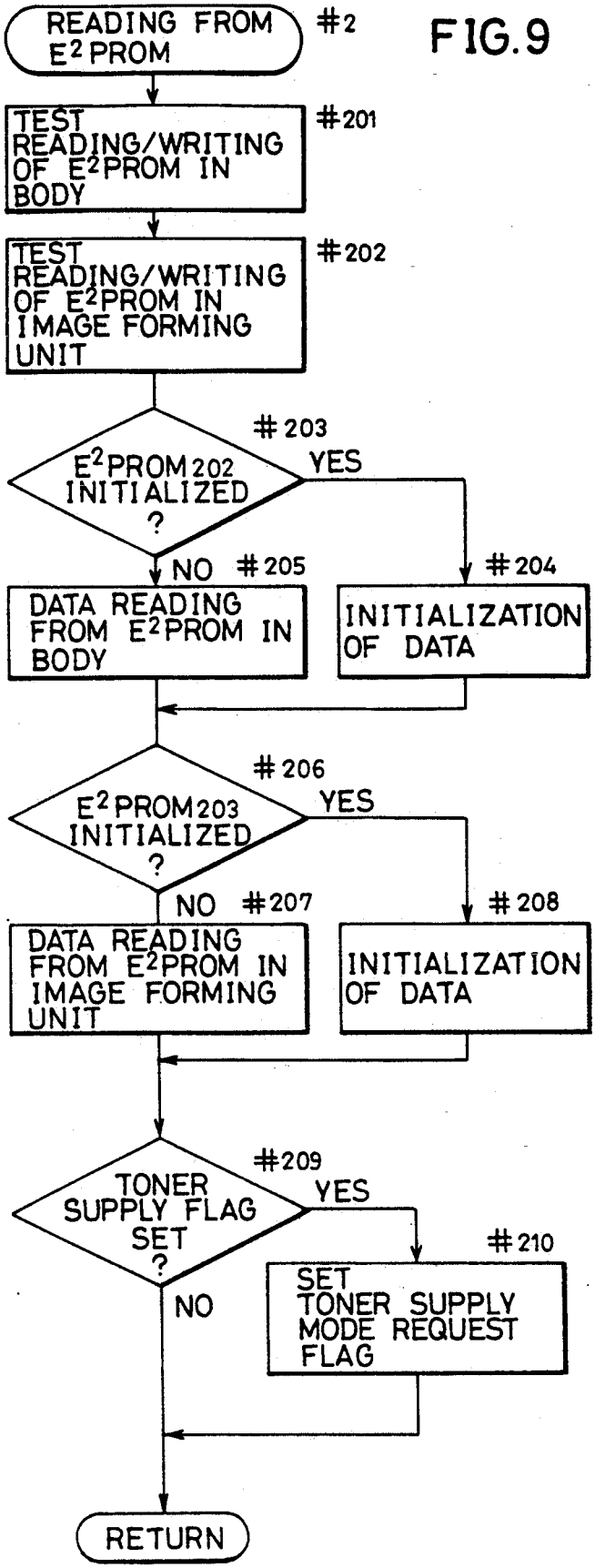
FIG. 9 is a flow chart diagram showing specific contents of a subroutine of reading executed by $E^2$PROM shown in FIG. 8.

FIG. 9 is a flow chart diagram showing procedure of the subroutine of reading from E²PROM at step #2.

First, writing and reading to and from a predetermined address of E²PROM 202 in body 1 are tested (step #201). Subsequently, writing and reading to and from predetermined address of E²PROM 203 in image forming unit 40 are tested (step #202). In these tests, it is detected whether or not an abnormal state of connection exists between E²PROMs 202 and 203. Thereafter, data is read out of a second address different from the above-mentioned address in E²PROM 202 (for example, address of the image formation counter) and based on contents of the read-out data, the initial state of E²PROM 202 is checked (step #203). When E²PROM 202 is in its initial state, initial data is written in E²PROM 202 at step #204. When E²PROM 202 is not in the initial state, data of various modes and flags stored in E²PROM 202 are read out and written in RAM 204 (step #205). Likewise, as in step #203, the initial state of E²PROM 203 in image forming unit 40 is checked (step 206). When E²PROM 203 is in its initial state, initial data is written in E²PROM 203 at step #208. On the other hand, when E²PROM 203 is not in the initial state, information such as lifetime of developing unit 4 and the toner empty flag stored in E²PROM 203 is read out and written in RAM 204 (step #208).

At step #209, it is determined whether or not the toner supply flag has been set. This toner supply flag is set when a toner bottle is emptied and the toner concentration is no more than 4%. If this flag has been set, a toner supply mode request flag is set, while when this flag has not been set, the operation immediately returns to the main routine.

Figure 10:
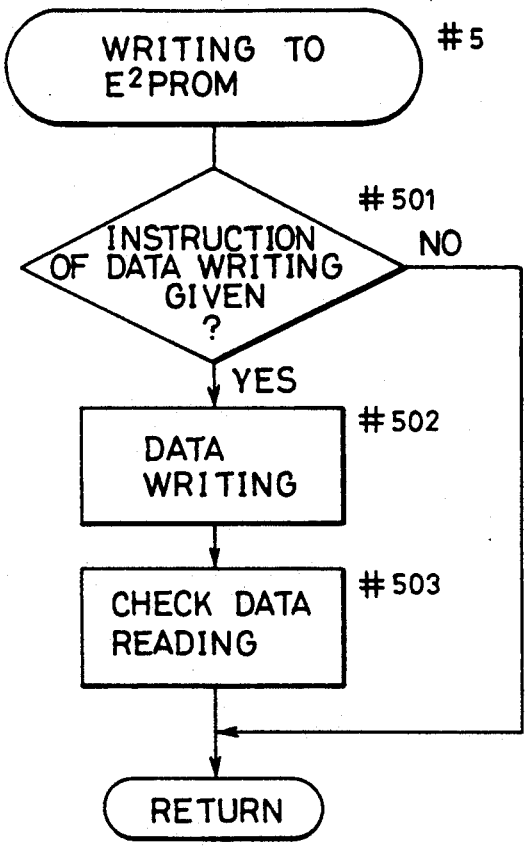
FIG. 10 is a flow chart diagram showing specific contents of a subroutine of writing executed by $E^2$-PROM shown in FIG. 8.

FIG. 10 is a flow chart diagram showing the subroutine of reading/writing to and from E²PROM. When instructions of data writing are given in each control program, the instructions are detected and data is written in (steps #501 to #503). Thereafter, the written data is read out again to be compared with those data for writing and thus, whether the writing has been correctly performed or not is checked.

Subsequently, a procedure for controlling the respective elements in the image forming unit will be described. FIGS. 11A to 11F are flow chart diagrams showing the subroutines for the control procedure. In these subroutines, control is made on the respective elements in the image forming unit according to 18 states of $0_H$ to $24_H$.

In state $0_H$, it is determined whether copying is to be started or not according to the subroutine for checking copy start as will be described later (#601). When copy start is allowed, state of $1_H$ is set and the timing roller is stopped (#602). Further, a timer for turning on the main motor is set (#603). When it is determined in the subroutine for checking copy start that toner supply mode has been set, state of $20_H$ is set. Next, in state $1_H$, starting of the main motor is controlled (#611 to 613). In state $2_H$, transfer charger 6 and exposure lamp 9 are turned on and paper feed by paper feed roller 31 is allowed (#621 to 625).

In state $3_H$, it is ensured that paper is supplied (#631 to 635). In state $4_H$, a timer for scanning start is set (#641 to 643). Further, in state $5_H$, sensitizing charger 5 is turned on and a toner concentration check flag is set (#651 to 654). In state $6_H$, the trailing edge of a sheet of copy paper being fed to transfer charger 6 is detected (#661 to 664). In state $7_H$, end of scanning operation is ensured after a time set in timer has passed and sensitizing charger 5 is turned off (#671 to 674). In state $8_H$, after the completion of scanning is ensured, a scan end flag is reset and exposure lamp 9 is turned off (#681 to 686).

In state $9_H$, a copy stop is checked according to a copy stop check subroutine as will be described later (#691). When copying is to be stopped, or when a carry flag has been set, exposure lamp 9 is turned off (#695). If copying is not to be stopped, or when the carry flag has been set, determination is made as to whether scanning has been completed or not (#692). When the scanning has not been completed, exposure lamp 9 is turned on (#693). Then, the operation turns back to state $3_H$ (#694) to perform the subsequent scanning. In states $A_H$ to $D_H$, various processings for stop are made. Especially in state $A_H$, when optical scanning device 10 is at home position (right side in FIG. 1) (#701), and in state $C_H$, until the main motor stops (NO at #801), start of copying is checked according to the copy start check subroutine shown in FIG. 12 and thus the copying operation is always monitored.

Figure 11A:
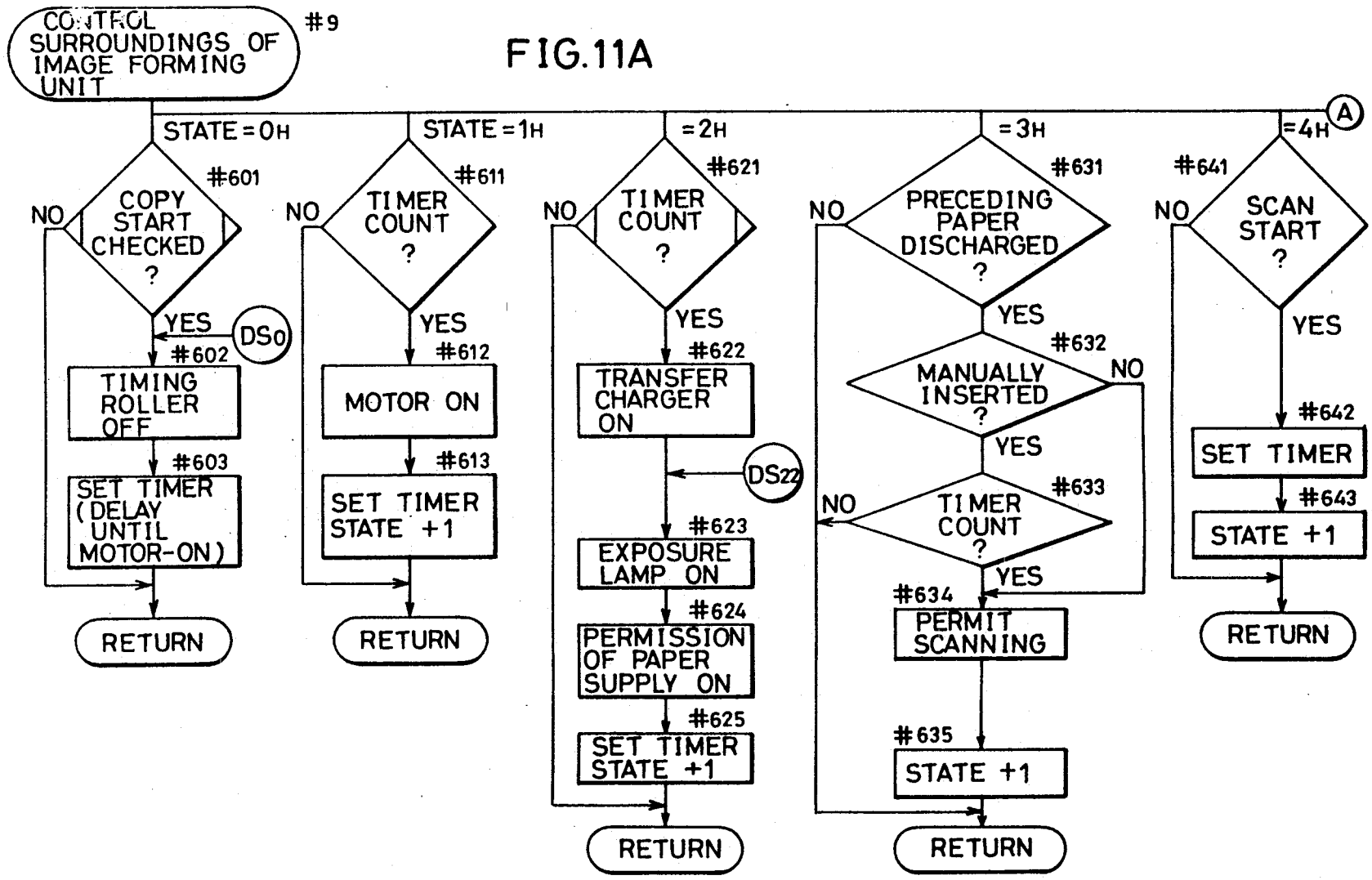
FIGS. 11A to 11F are flow chart diagrams showing specific contents of subroutines for controlling surroundings of the image forming unit shown in FIG. 8.
Figure 11B:
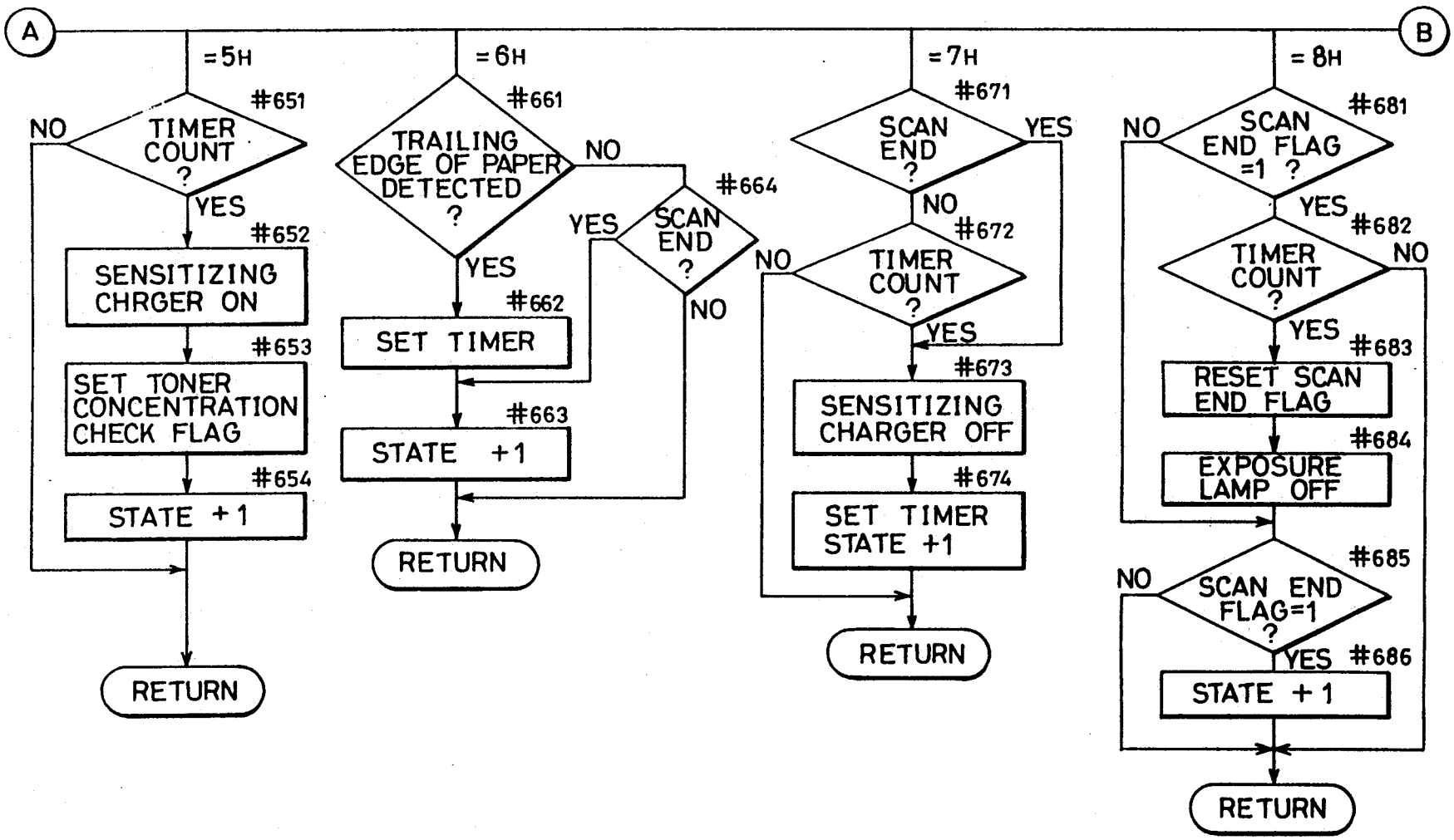
Figure 11C:
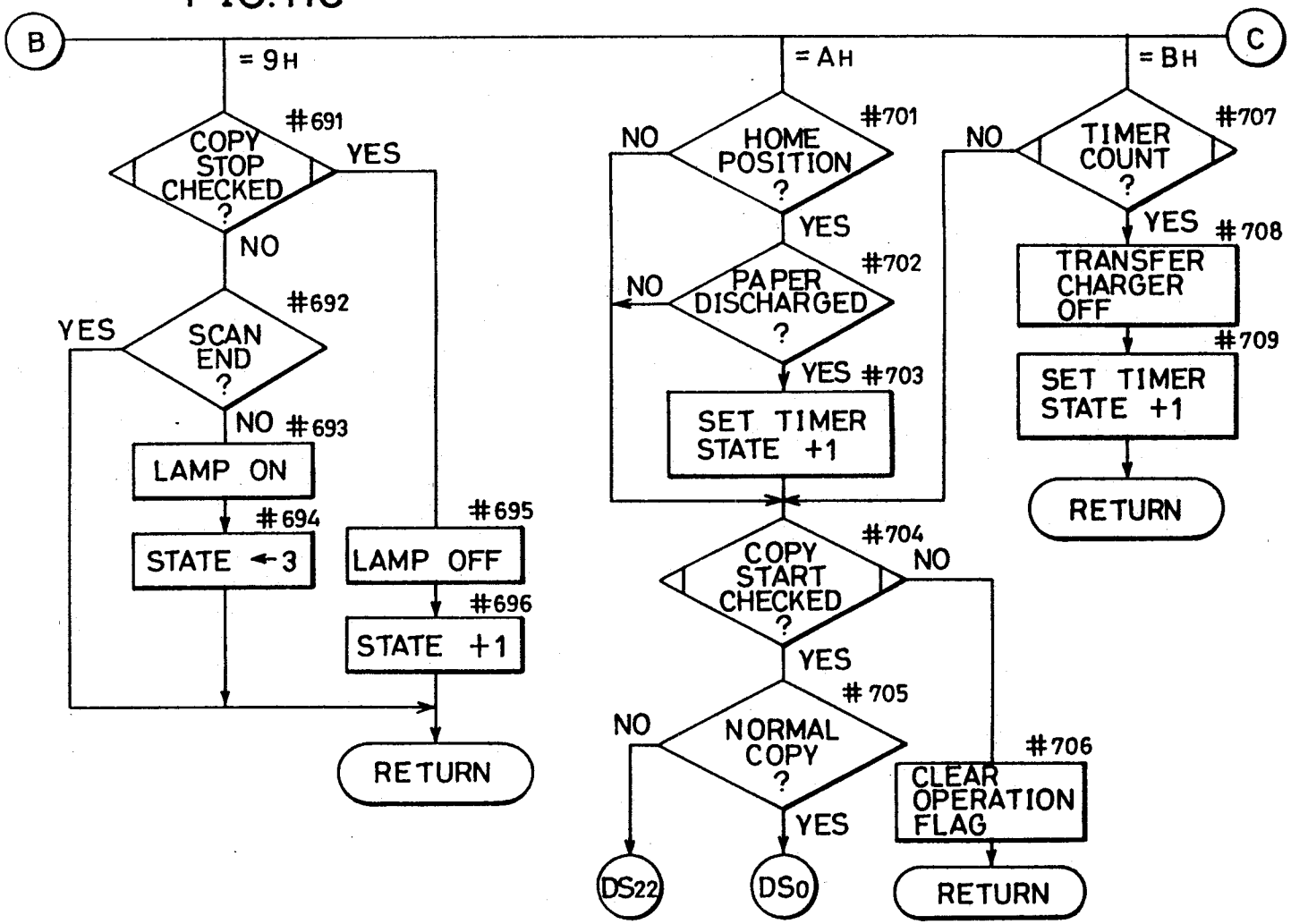
Figure 11D:
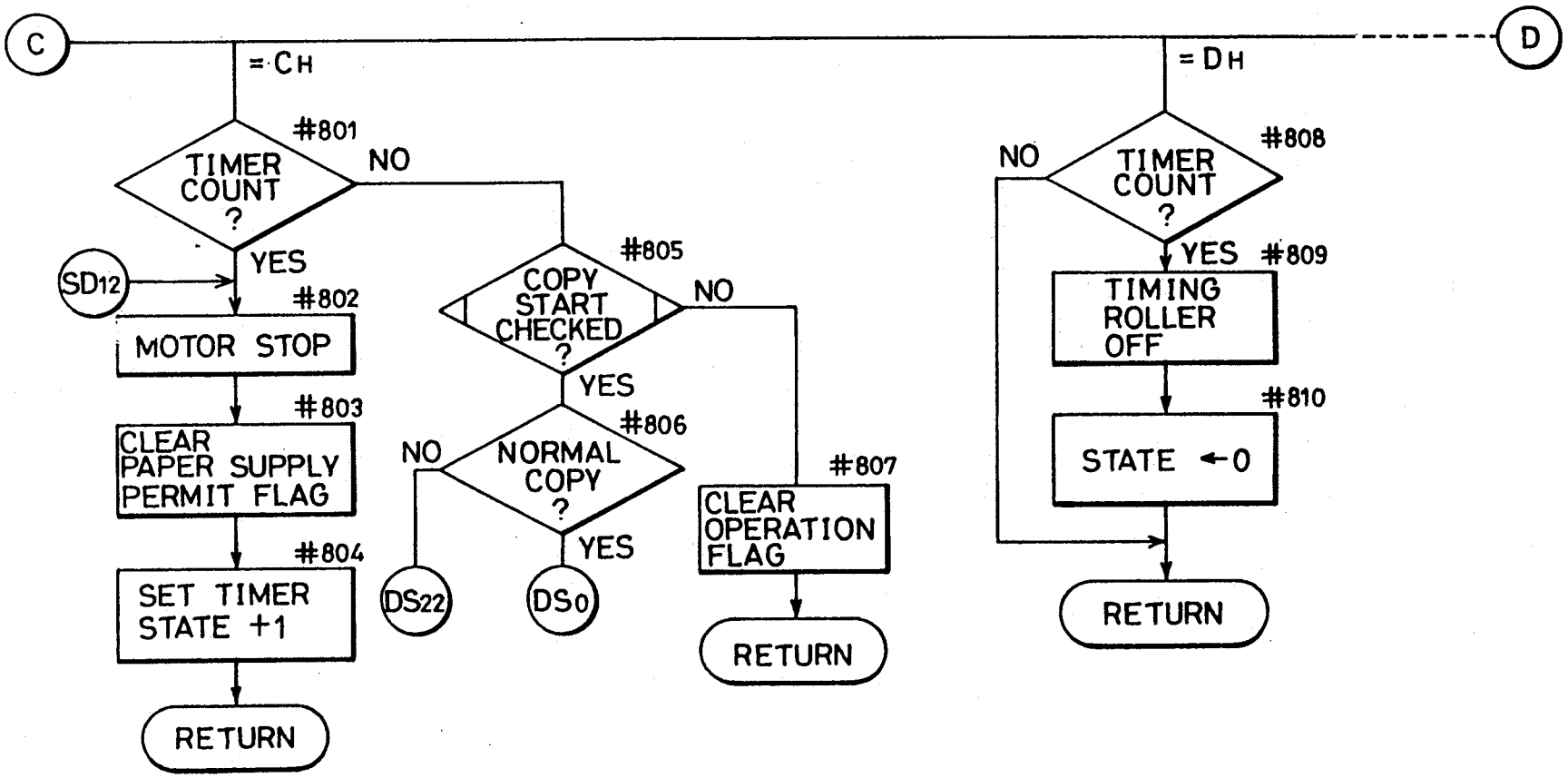
Figure 11E:
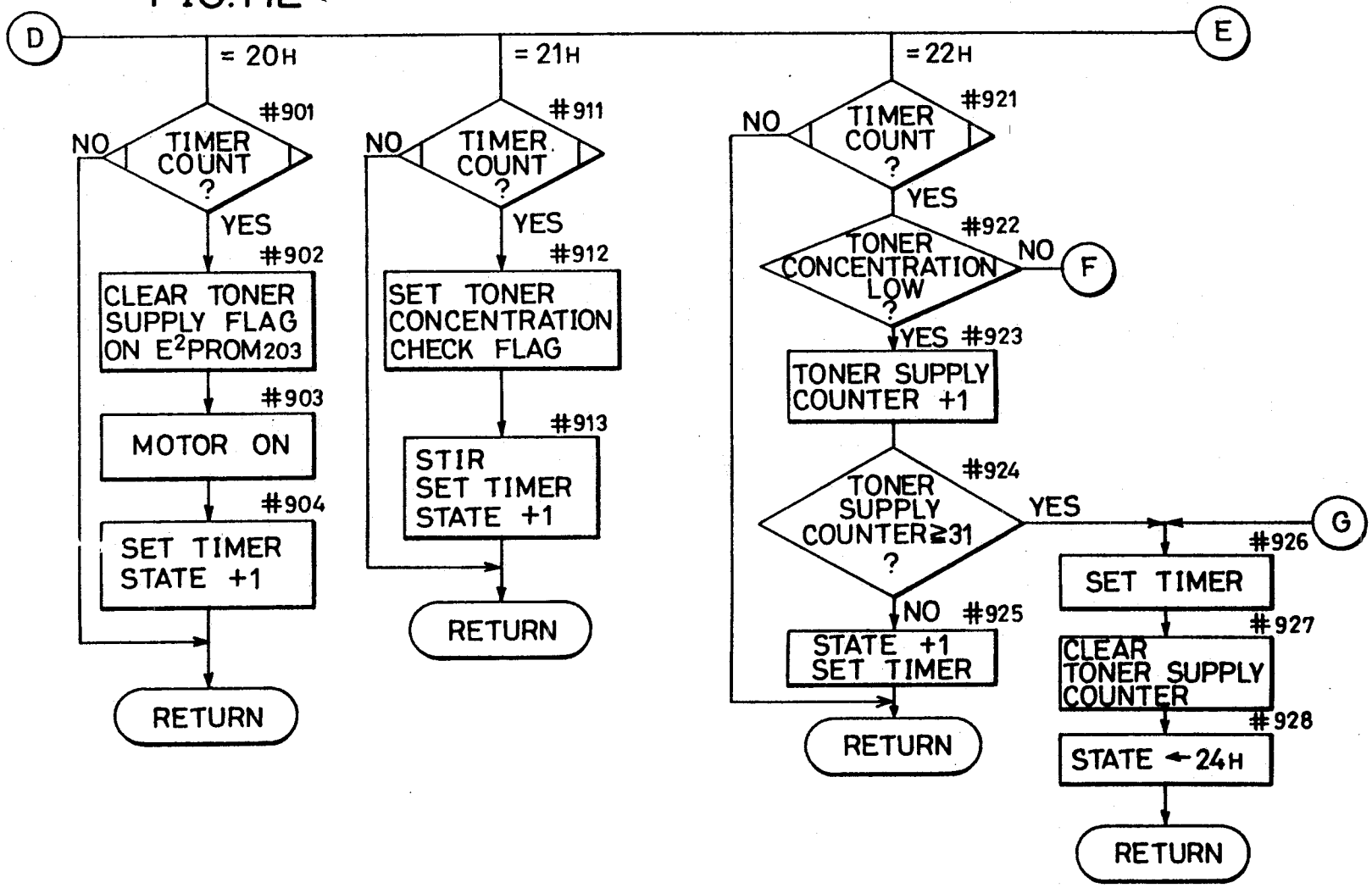
Figure 11F:
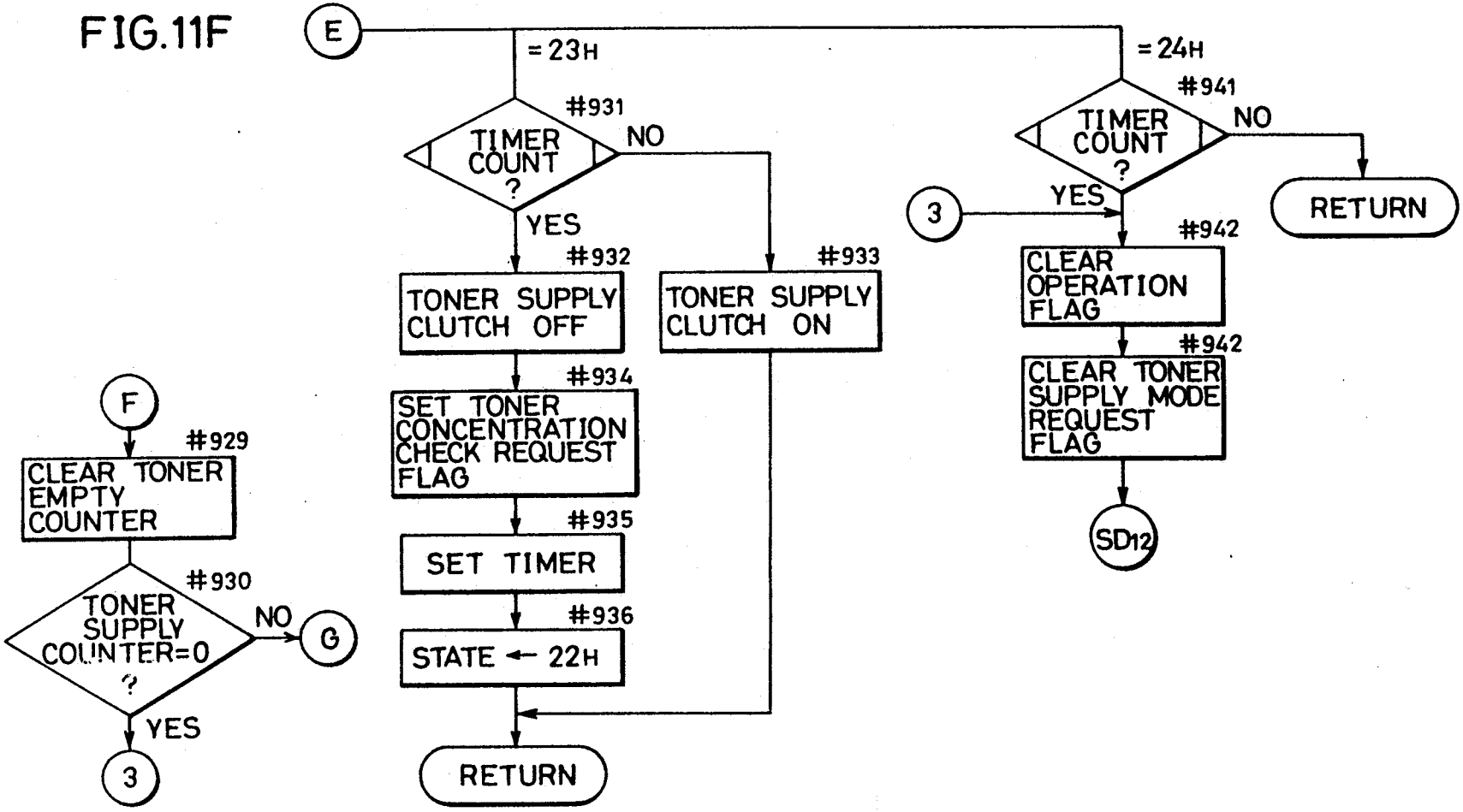
Figure 12:
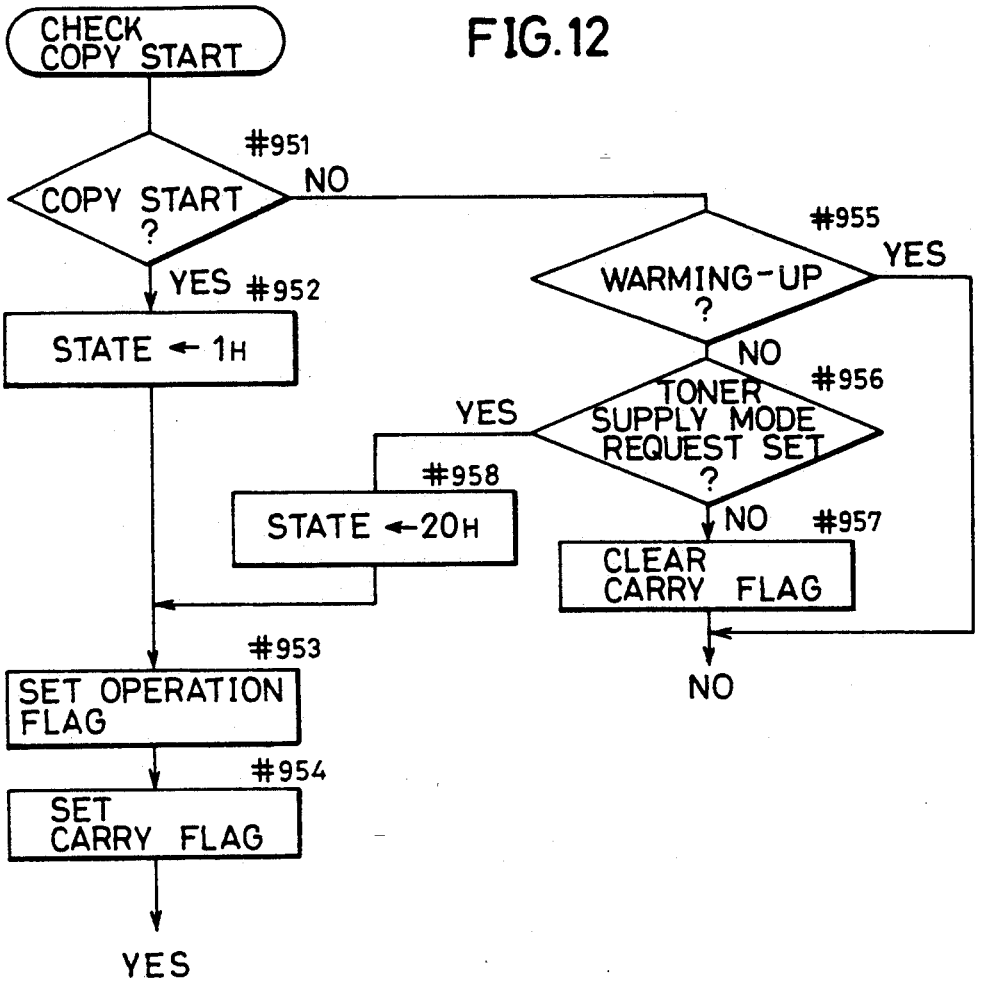
FIG. 12 is a flow chart diagram showing specific contents of a routine for checking start of copying.

FIGS. 11E and 11F are flow chart diagrams relating to the toner supply mode which is the main subject of the present invention. When a start of the toner supply mode is detected, after a predetermined time has passed at step #901 for state $20_H$, the toner supply flag in E²PROM 203 is cleared (step #902) and supply motor 181 is turned on (step #903). Subsequently, an interval timer is set, the state is incremented by one (step #904), and then the operation returns to the main routine. In state $21_H$, after a predetermined time has passed at step #911, a toner concentration check flag is set (step #912). Thereafter, the stirring time at transport conveyer 12 is set, the state is incremented by one (step #913), and then the operation returns to the main routine.

In state $22_H$, after a predetermined time has passed (step #921), determination is made as to whether a toner low concentration flag has been set or not (step #922). When the flag has been set, the toner supply counter is incremented by one (step #923), which counts time of supply operations performed in the fast toner supply mode. Subsequently, it is determined whether the toner supply counter represents 31 or not (step #924). When the count value is smaller than 31, the state is incremented by one, and the interval timer is set (step #925), and then the operation returns to the main routine. When the time of supplies has reached 31, a timer is set (step #926), the toner supply counter is cleared (step #927), and state $24_H$ is set (step #928).

On the other hand, when the toner low concentration flag has not been set at step #922, the toner empty detection counter in E²PROM 203 is cleared (step #929). Thereafter, it is determined whether the toner supply counter represents 0 or not, or detected whether toner supply has been made or not (step #930). If the toner supply has not been conducted at all (=0), the operation proceeds to step #942 for state $24_H$ as will be described later. Further, if toner supply has been made even once at all, the operation returns to step #926 to set a timer for stirring the supplied toner, and further proceeds to state $24_H$.

In the subsequent state $23_H$, a timer counts at step #931 and until a predetermined value is counted up, the apparatus receives output of motor 181 at step #933 to turn on an unshown toner supply clutch. Thereafter, the operation returns to the main routine and after a predetermined time is counted up, the clutch is turned off at step #932. Subsequently, a toner concentration check request flag is set at step #934, a timer for turning off the toner supply clutch is set (step #935), the state is returned to $22_H$ (step #930) and then the operation returns to the main routine.

The operation proceeds to state $24_H$ when the time of toner supplies has reached 31 or when the toner concentration becomes high. When a timer counts up a predetermined time at step #941 in this state, an operation flag is cleared (#942), the toner supply request flag is cleared (step #943) and then the operation proceeds to SD12 operation, or to the routine for stopping machine operation following step #802 in state $C_H$ in FIG. 11D.

As has been described above, toner is supplied unconditionally in states $20_H$ to $24_H$. The toner supply is continued until the toner supply and stirring is repeated predetermined times or until it is detected that the toner concentration in developing unit 4 has exceeded a predetermined value. Thus, an exchange of toner containers 141 is conducted when the toner concentration becomes low, or no more than 4% at the time of detection. Then, cover 110 is opened to turn power off and a new toner container 141 filled with toner is inserted in developer supply unit 11. Thereafter, cover 110 is closed and when power is turned on, a predetermined amount of toner is supplied in this state or toner is supplied until a predetermined concentration is reached. Therefore, even at a first time after the exchange of toner containers 141, copying at a low concentration is not conducted, preventing failure of copying.

Subsequently, the copy start check subroutine which is executed in the above-mentioned states $0_H$, $A_H$ and $C_H$ will be described. In the copy start check subroutine shown in FIG. 12, a copy start flag is first checked at step #951. When the copy start flag has been set, namely when the print switch has been turned on, state $1_H$ is set (step #952). Thus, from the next time, the operation will be started from state $1_H$. Thereafter, the operation flag is set (step #953), the carry flag used for a determination step is set (step #954), and then the operation returns to the original flow.

On the other hand, when the copy start flag has not been set at step #951, it is determined whether the apparatus is being warmed up or not (step #955). When the apparatus is being warmed up, copying operation is not made in order to protect fixing device 34, and the operation immediately returns to the original flow. When the apparatus is not being warmed up, it is determined whether a toner supply mode request has been set or not, or whether or not a toner supply set flag has been set to request operation in the toner supply mode (step #956). When the toner supply mode request flag has not been set, the carry flag is cleared (step #957) and the operation returns to the original flow. On the other hand, when the toner supply mode request flag has been set, in order to execute the toner supply mode from the above-mentioned state $20_H$, state $20_H$ is set (step #958) and the operation returns to step #953.

The toner supply mode request flag is set at step #210 of the subroutine (step #2) for initial setting of E²-PROM with power turned on, to supply toner unconditionally after it is determined at step #209 that a toner supply flag has been set. The toner supply flag is set when emptied toner is detected at step #1020 in the subroutine (step #10) for controlling detection of toner concentration, as will be described later, and the toner concentration is no more than 4%. Thus, the toner supply mode request flag realizes the main subject of the present invention, i.e.; when emptied toner is detected and the toner concentration is no more than 4%, this flag enables unconditional supply of toner upon power-on after an exchange of toner containers 141.

Figure 13:
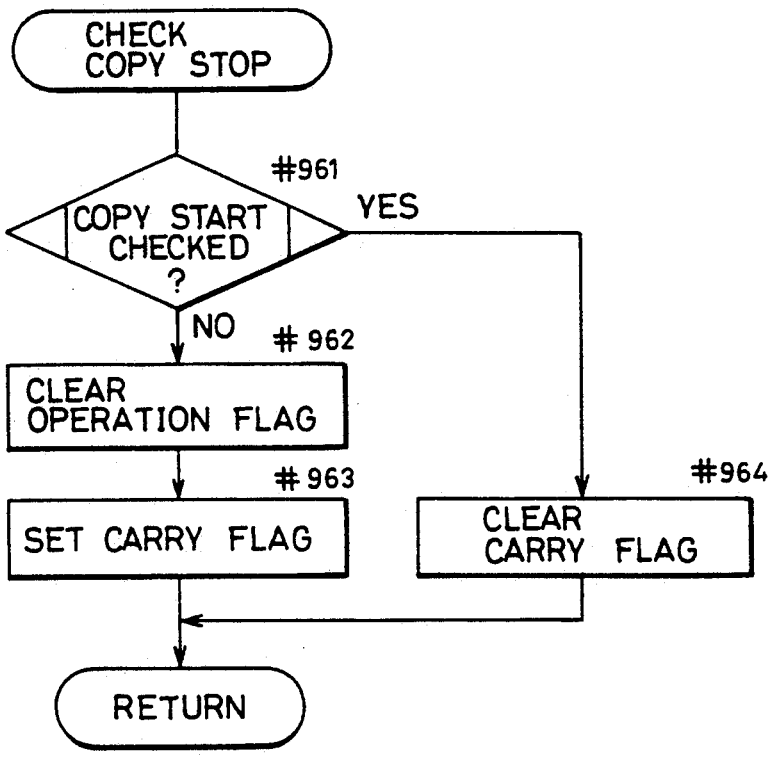
FIG. 13 is a flow chart diagram showing specific contents of a routine for checking stop of copying.

Subsequently, the subroutine for checking copy stop as shown in FIG. 13 will be described. First, at step #961, determination is made as to whether a copy start flag has been set or not. When this flag has not been set, in order to stop copying, the operation flag is cleared (step #962), the carry flag is set (step #963) and then the operation returns to the original routine. On the other hand, when the copy start flag has been set, to continue copying operation, the carry flag is cleared and the operation returns to the original routine. Meanwhile, the carry flag here is used to determine whether copying is to be continued or stopped in the original routine.

Figure 14B:
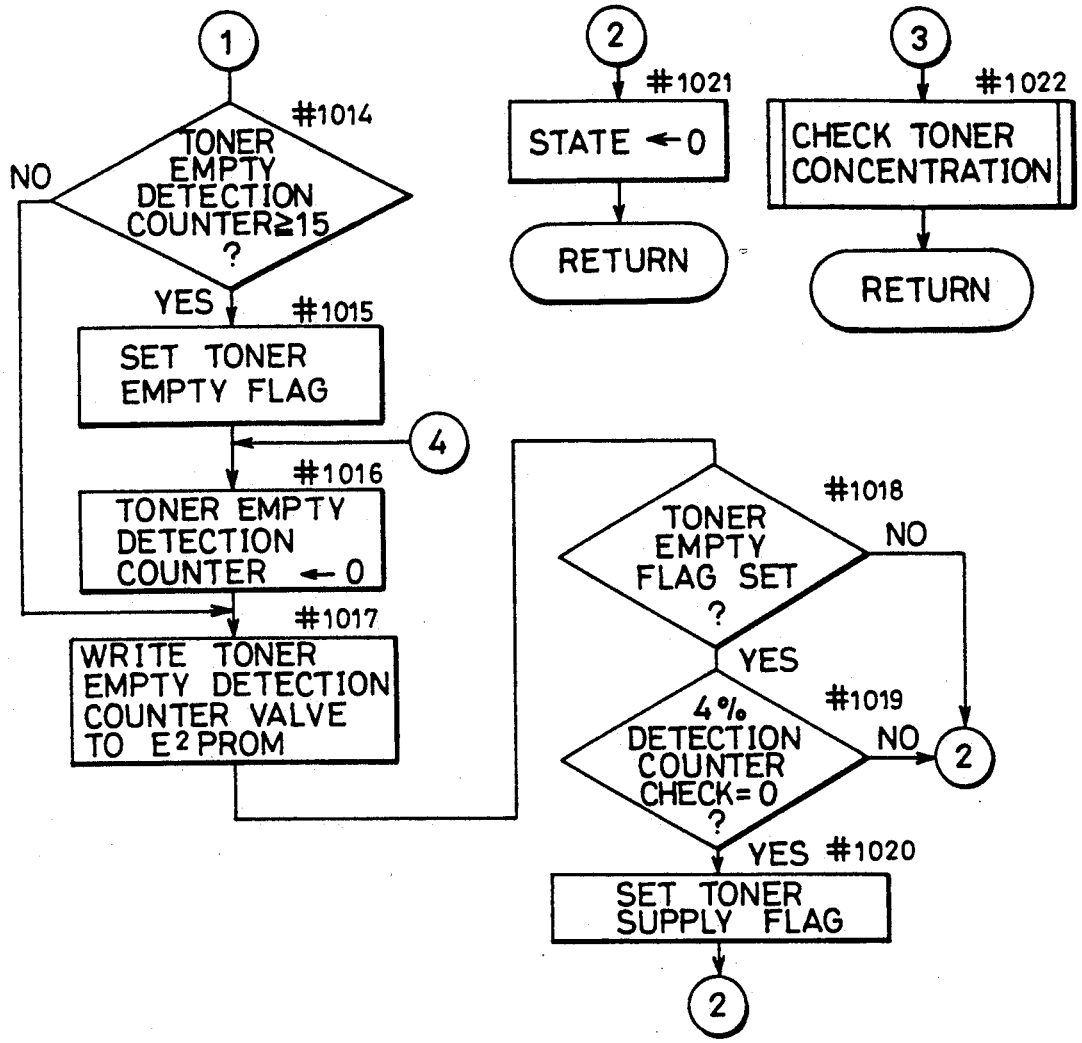

Further, the subroutine for controlling detection of toner concentration at step #10 in the main routine will be described. FIGS. 14A and 14B are flow chart diagrams of this subroutine. In the normal copying operation, toner concentration in the developing unit is detected to control the toner concentration such that it is held at a certain level. The control is conducted in two states of 0 and 1. In state 0, preparation is made for the detection and in state 1, an actual detecting operation is performed.

First, at step #1001, either of the two states is selected. In the case of state 0, whether check of toner concentration has been requested or not is detected based on set or reset of a toner concentration check flag (step #1002). If the request has not been made, the operation immediately returns to the main routine. If the request has been made, the toner concentration check flag is cleared at step #1003. Subsequently at step #1004, value of 8 is set in a counter for detecting 6%, a normal concentration. At step #1005, value of 8 is set in a counter for detecting 4%, a too low concentration. At step #1006, value of 16 is set in a counter for detecting the number of detection. The counters for detecting 6% and 4% are subtracted each time a low toner concentration is detected in the subsequent state 1 where the toner concentration is detected. When these counters eventually represent 0, it is determined that the toner concentration is low as a whole. The counter for detection number represents the number of determinations made on level of toner concentration and is subtracted each time a determination is made. When the detection number counter reaches 0, or the toner concentration has been detected 16 times, determination is made as to whether either of the counters for detecting 6% and 4% has reached 0 or not. That is, depending on whether a low toner concentration has been detected more than 8 times, it is determined whether the toner concentration is low or not. When all the counters have been set, to proceed to the subsequent state, the state is incremented by one (step #1007).

In state 1, first, the detection number counter is decremented by one and determination is made as to whether the result represents 0 or not (step #1008). When the detection number counter does not represent 0, or detection has not been made 16 times, the operation proceeds to the subroutine for checking toner concentration at step #1022. When the detection number counter represents 0, or when the detection of toner concentration has been conducted 16 times, determination represents 0 or not, or whether the toner concentration is low or not (step #1009). When the detection counter represents 0, or when the concentration is low, a low toner concentration flag is set (step #1010). On the other hand, when the detection counter does not represent 0, or when the toner concentration is high, the operation proceeds to step #1016 to set 0 in the toner empty detection counter and then the counted value is written in E²PROM 203 (step #1017).

On the other hand, when the low toner concentration flag has been set at step #1010, then determination is made as to whether the toner supply mode has been set or not according to the supply mode request flag (step #1011). When the toner supply mode has not been set, the number of toner supply is set (step #1012) and a set number of the toner empty detecting counter is counted up (step #1013). The toner empty detection counter detects whether toner has been emptied or not. According to this counter, emptiness of toner is determined when copying operation has been performed 15 times with a toner concentration lower than 6%. Subsequently, at step #1014, determination is made as to whether the counted value of the toner empty detection counter is larger than 15 or not. When the counted value is larger than 15, it is determined that toner has been emptied, the toner empty flag is set (step #1015) and then the above-mentioned steps #1016 to #1017 are executed.

Meanwhile, when the toner supply mode has been set at step #1011, the operation proceeds to step #1021. When the count value of the toner empty detection counter is smaller than 15 at step #1014, the operation proceeds to step #1017 without performing any further processing.

At step #1017, value of the toner empty detection counter is written in E²PROM 203 and determination is made as to whether the toner empty flag has been set or not (step #1018). When this flag has been set, it is determined whether the counter for detecting 4% represents 0 or not, or whether the toner concentration is no more than 4% or not (step #1019). When the toner concentration is no more than 4%, the toner supply flag is set (step #1020), the state is returned to 0 (step #1021) and the processing is completed to return to the main routine. This toner flag supply flag is set to determine whether the toner supply is to be unconditionally conducted or not when power is turned on. Further, when the toner empty flag has not been set at step #1018, or when the toner concentration is over than 4% at step #1019, the operation skips to step #1021.

Figure 15:
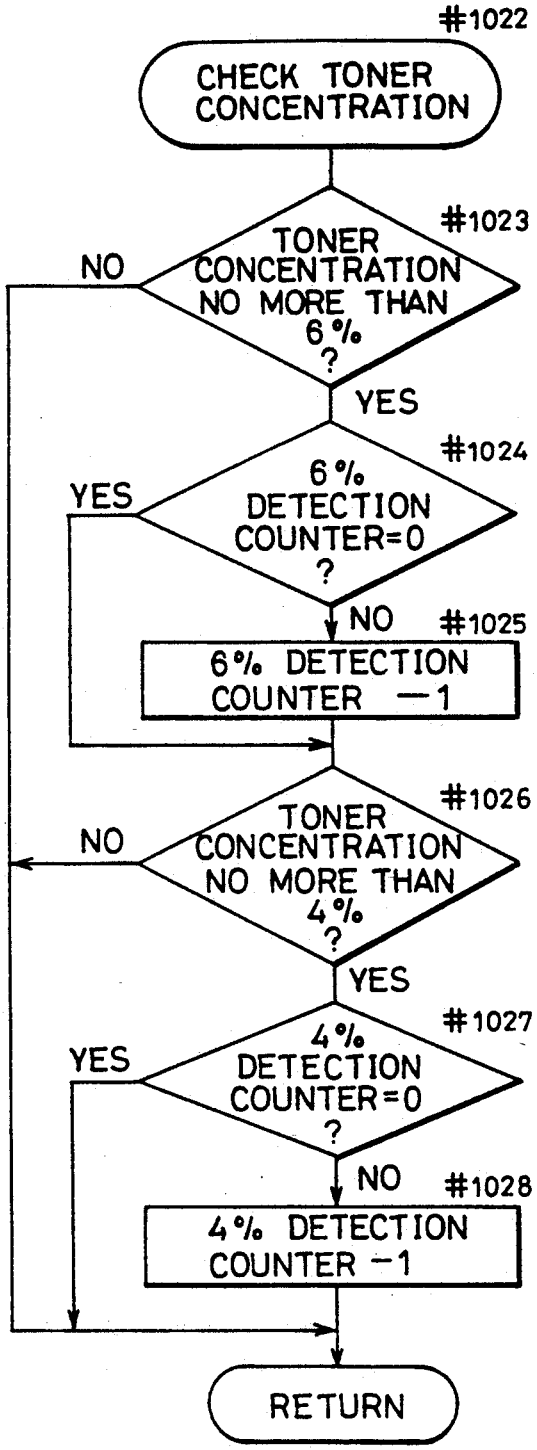
FIG. 15 is a flow chart diagram showing specific contents of a routine for checking toner concentration.

Subsequently, the subroutine for checking toner concentration as shown in FIG. 15 will be described. In this subroutine, whether the toner concentration is lower than 6% or 4%, or not is determined depending on whether output voltage from toner concentration sensor 13 is higher than a predetermined threshold value or not. Since this toner concentration sensor provides a further reduced output voltage as the toner concentration increases, a determination that the toner concentration is lower than 6% is made when a detected output voltage is higher than a first threshold value, and a determination that the concentration is lower than 4% is made when the detected output voltage is over a second threshold value higher than the first one. First, at step #1023, it is determined whether the toner concentration is no more than 6% or not. When the toner concentration is larger than 6%, the operation returns to the main routine without performing any other processing. When the toner concentration is no more than 6%, it is determined whether the counter for detecting 6% is representing 0 or not (step #1024). When the counter value is not 0, or when the determination that the toner concentration is no more than 6% is not made, value of the counter for detecting 6% is decremented by one (step #1025). When the count value is 0, or when it is determined that the number of detection is no less than 8 and thus the toner concentration is no more than 6%, the operation skips step #1025 since the determination that the toner concentration is no more than 6% has been made. Subsequently, determination is made at step #1026 as to whether the toner concentration is no more than 4% or not. When the toner concentration is larger than 4%, the operation returns to the main routine without performing any other processing. When the toner concentration is no more than 4%, it is determined whether the counter for detecting 4% is representing 0 or not (step #1027). When the count value is not 0, or when the determination that the concentration is no more than 4% has not been made, value of the counter for detecting 4% is decremented by one (step #1027) and the operation returns to the main routine. When the count value is 0, or when the determination that the concentration is no more than 4% has been made, the operation skips step #1028 and returns to the main routine.

Figure 16:
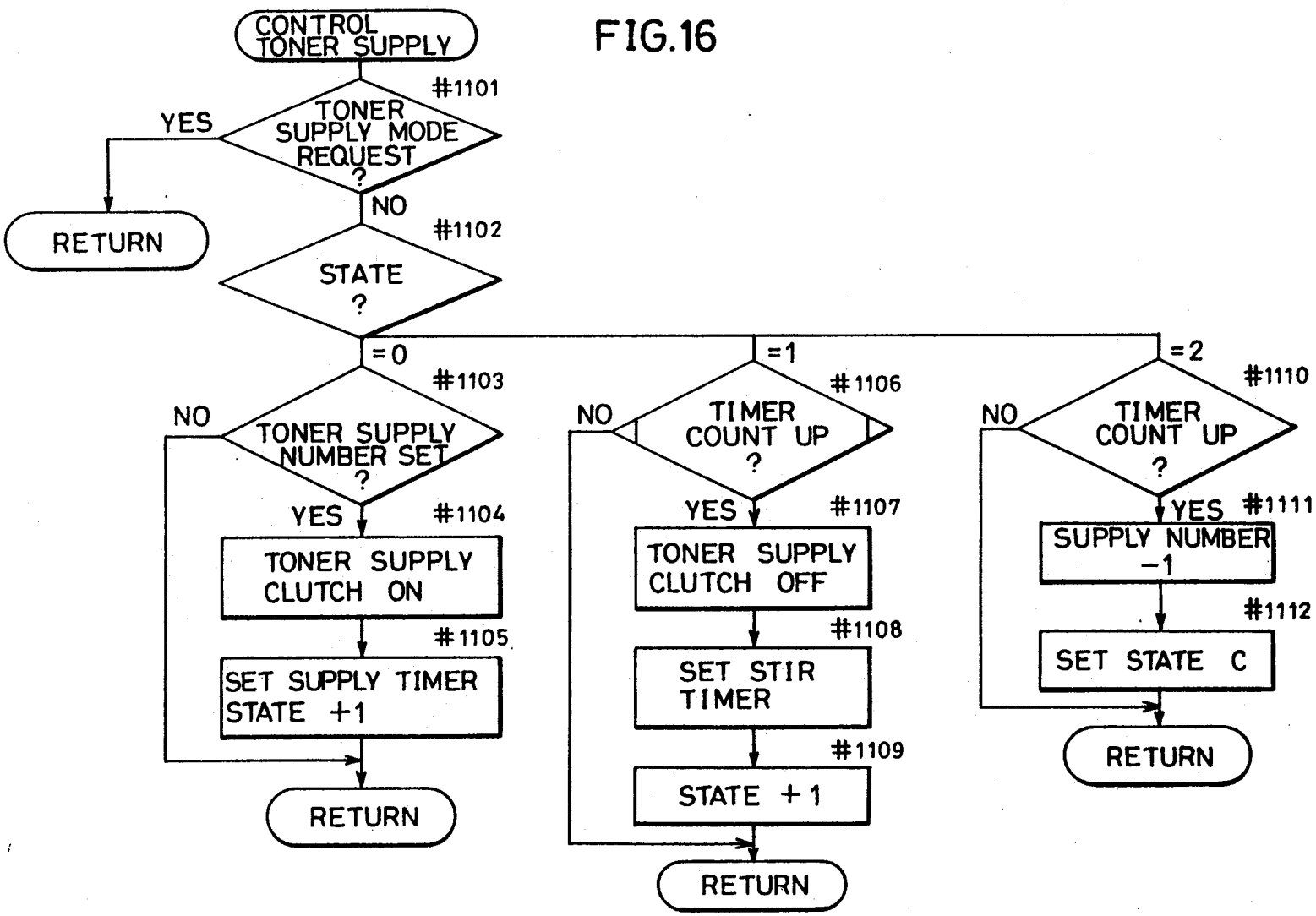
FIG. 16 is a flow chart diagram showing specific contents of a routine for controlling toner supply.

Further, the subroutine (step #11) for controlling toner supply as shown in FIG. 16 will be described. In this subroutine, the normal toner supply operation performed in the copying operation is controlled. When conditions for toner supply are met, the toner supply operation and the stirring operation for the supplied toner are repeated predetermined times.

First, at step #1101, determination is made as to whether the toner supply mode has been requested or not. When the toner supply mode request flag has been set, the toner supply operation is not performed in this subroutine but the operation returns to the main routine. When this flag has not been set, the operation proceeds to the subsequent step #1102 to perform the normal toner supply and state of control is checked. When state=0, determination is made at step #1103 whether the number of toner supply has been set or not. The toner supply number is counted by a counter which determines how many times the toner supply operation is to be made when the determination that the toner concentration is low is made in the normal copying operation, and generally it is set to 1 or 3. If the toner supply number has been set, the toner supply clutch is turned on at step #1104. Then, a timer for toner supply is set, the state is incremented by one (step #1105) and the operation returns to the main routine. If the toner supply time has not been set, the operation returns to the main routine without performing any other processing.

In state 1, no processing is made until a predetermined time has passed. When the predetermined time has passed (step #1106), the toner supply clutch is turned off (step #1107), a timer for stirring is set (step #1108), the state is incremented by one (step #1109) and then the operation returns to the main routine.

Subsequently, in state 2, no processing is made until a predetermined time has passed. After the predetermined time has passed (step #1110), the supply time is decremented by one (step #1111), the state is set to 0 (step #1112) and then the operation returns to the main routine.

While in the present embodiment, presence or absence of toner in the container, or emptiness of the toner container is determined indirectly depending on output of the toner concentration sensor, the present invention is not limited to this embodiment only. For example, an emptied toner container may be detected by directly monitoring toner supply from the container or by other means such as measuring weight of the container.

Further, while in the present embodiment, it is determined based on the toner supply flag whether toner supply operation is required o not in changing toner containers, the present invention is not limited to this embodiment only. For example, a flag concerning emptiness of toner and a flag indicating that the toner concentration is no more than 4% may be stored in storage means, $E^2$PROM and based on setting/resetting of those flags, it may be determined whether toner supply operation is necessary or not.

Furthermore, while in the present embodiment, when power is turned on by closing the cover, an exchange of toner containers is detected to check toner supply operation, the present invention is not limited to this embodiment only. For example, an exchange of toner containers may be directly detected to check the toner supply operation.

As has been described above, according to the present invention, the toner supply flag indicative of toner supply is set when a toner container is emptied and the toner concentration in developing means is low (for example, no more than 4%). This flag is stored in storage means, based on which toner is rapidly supplied when the toner container is changed. Therefore, even immediately after the exchange, images of an appropriate toner density can be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus provided with a developing unit for developing an electrostatic latent image formed on an electrostatic latent image holding member, comprising:

measuring means for measuring toner concentration in the developing unit;

a toner container for storing toner;

first supply means for supplying a predetermined amount of toner from said toner container to said developing unit when it is determined that the toner concentration measured by said measuring means is lower than a first predetermined concentration;

second supply means for supplying from said toner container to said developing unit toner of a larger amount than said first supply;

storage means for storing predetermined information related to concentration when it is determined that the toner concentration measured by said measuring means is below a second predetermined concentration lower than said first predetermined concentration; and actuating means for actuating said second supply means when power to said apparatus is turned on after being off if said predetermined information has been stored in said storage means prior to the time that said power is turned on.

2. The image forming apparatus according to claim 1, wherein said storage means stores said predetermined information when said toner container has been emptied and said measured toner concentration is lower than said second predetermined concentration.

3. The image forming apparatus according to claim 2, wherein emptiness of said toner container is identified by determining, based on output from said measuring means, that the toner concentration is not increasing.

4. The image forming apparatus according to claim 1, further comprising:

control means for inhibiting image forming operation if said predetermined information has been stored in said storage means when power is turned on.

5. An image forming apparatus provided with a developing unit which is detachable from body of the apparatus and develops an electrostatic latent image formed on an electrostatic latent image holding member comprising:

measuring means for measuring toner concentration in the developing unit;

a toner container for storing toner;

first supply means for supplying a predetermined amount of toner from said toner container to the developing unit when it is determined that the toner concentration measured by said measuring means is lower than a first predetermined concentration;

second supply means for supplying from said toner container to said developing unit toner of a larger amount than said first supply means;

storage means detachably provided to the body of the apparatus together with said developing unit for storing predetermined information related to concentration;

writing means for writing said predetermined information into said storage means when the toner concentration is below a second predetermined concentration lower than said first predetermined concentration; and actuating means for actuating said second supply means if said predetermined information has been stored in said storage means when power is turned on.

6. The image forming apparatus according to claim 5, wherein said storage means stores said predetermined information when said toner container has been emptied and said measured toner concentration is lower than said second predetermined concentration.

7. The image forming apparatus according to claim 5, further comprising:

control means for inhibiting operation of said first supply means when said second supply means is operating.

8. An image forming apparatus provided with a developing unit which develops an electrostatic latent image formed on an electrostatic latent image holding member, comprising:

measuring means for measuring toner concentration in the developing unit;

a toner container for storing toner;

supply means for supplying a predetermined amount of toner from said toner container to said developing unit;

storage means for storing predetermined information indicating that said measured toner concentration in said developing unit is lower than a predetermined concentration; and actuating means for actuating said supply means at the same time that power to said apparatus is turned on after being off if said predetermined information has been stored in said storage means prior to the time that said power is turned on.

9. The image forming apparatus according to claim 8, wherein said storage means includes a memory and means for writing and reading information to and from said memory, said memory being detachably provided to body of the apparatus together with said developing unit.

10. An image forming method in which an electrostatic latent image formed on an electrostatic latent image holding member is developed by toner in a developing unit, including the steps of:

measuring toner concentration in the developing unit;

comparing said measured toner concentration with a first predetermined concentration and with a second predetermined concentration lower than said first predetermined concentration;

supplying toner of a first predetermined amount when it is determined that said measured toner concentration is lower than said first predetermined concentration;

storing predetermined information when it is determined that said measured toner concentration is lower than said second predetermined concentration;

turning power off once and then turning on the same again;

supplying toner of a second predetermined amount larger than said first predetermined one, based on said stored predetermined information.

11. An image forming apparatus provided with a developing unit for developing an electrostatic latent image formed on an electrostatic latent image holding member, comprising:

measuring means for measuring toner concentration in the developing unit;

storage means for storing predetermined information when it is determined that the toner concentration measured by said measuring means is lower than a predetermined concentration; and control means for, when power to said apparatus is turned on after being off, inhibiting image forming operation based on said predetermined information which has been stored in said storage means prior to the time that said power is turned on.

12. The image forming apparatus according to claim 11, further comprising:

a toner container for storing toner;

supply means for supplying toner from said toner container to said developing unit; and actuating means for actuating said supply means based on said predetermined information in said storage means when power is turned on.

* * * * *

UNITED STATES PATENT AND TRADEMARK OFFICE

CERTIFICATE OF CORRECTION

PATENT NO. : 5,253,020

DATED : October 12, 1993

INVENTOR(S) : Tetsuo Matsushita, et al.

It is certified that error appears in the above-identified patent and that said Letters Patent is hereby corrected as shown below:

In col. 12, line 25, before "represents" insert --is made as to whether the counter for detecting 6%--.

In col. 14, line 35, change "0" to --or--.

Signed and Sealed this

Fifth Day of April, 1994

Bruce Lehman

*Attest:*

BRUCE LEHMAN

*Attesting Officer*

*Commissioner of Patents and Trademarks*